US005778840A

United States Patent [19]

Murata et al.

[11] Patent Number: 5,778,840

[45] Date of Patent: Jul. 14, 1998

[54] VARIABLE VALVE DRIVING MECHANISM

[75] Inventors: Shinichi Murata; Jun Isomoto; Masahiko Kubo; Takaaki Hirano, all of Tokyo, Japan

[73] Assignees: Mitsubishi Jidosha Kogyo K.K.; Mitsubishi Jidosha Engineering K.K., both of Tokyo, Japan

[21] Appl. No.: 776,244

[22] PCT Filed: May 24, 1996

[86] PCT No.: PCT/JP96/01390

§ 371 Date: Jan. 24, 1997

§ 102(e) Date: Jan. 24, 1997

[87] PCT Pub. No.: WO96/37689

PCT Pub. Date: Nov. 28, 1996

[30] Foreign Application Priority Data

May 25, 1995 [JP] Japan ..... 7-126747

[51] Int. Cl.[6] ..... F01L 13/00

[52] U.S. Cl. ..... 123/90.17; 123/90.31

[58] Field of Search ..... 123/90.15, 90.17, 123/90.31, 90.6; 74/568 R; 464/1, 2, 160

[56] References Cited

U.S. PATENT DOCUMENTS

| | | | |
|---|---|---|---|
| 3,633,555 | 1/1972 | Raggi | 123/90.17 |
| 5,161,493 | 11/1992 | Ma | 123/90.17 |
| 5,219,313 | 6/1993 | Danieli | 464/2 |
| 5,333,579 | 8/1994 | Hara et al. | 123/90.17 |
| 5,361,736 | 11/1994 | Phoenix et al. | 123/90.17 |
| 5,365,896 | 11/1994 | Hara et al. | 123/90.17 |
| 5,417,186 | 5/1995 | Elrod et al. | 123/90.17 |

FOREIGN PATENT DOCUMENTS

| | | |
|---|---|---|
| 47-20654B | 6/1972 | Japan . |
| 5-202718A | 8/1993 | Japan . |

OTHER PUBLICATIONS

F. Freudenstein, E.R. Maki, and Lung-Wen Tsai, *The Synthesis and Analysis of Variable-Valve-Timing Mechanisms for Internal-Combustion Engines*, pp. 1–10, International Congress and Exposition, Detroit, Michigan, Feb. 29–Mar. 4, 1988; SAE Technical Paper Series #880387, ©1988.

*Primary Examiner*—Weilun Lo

[57] ABSTRACT

A variable valve driving mechanism is provided with an eccentric member (14) having an annular eccentric portion (15), which is eccentric relative to a camshaft (11), and arranged on an outer periphery of the camshaft (11); an intermediate rotating member (16) having a first groove portion (16A) and second groove portion (16B), which extend in radial directions, and rotatably supported on the eccentric portion (15); a cam lobe (12) having a cam portion (6) for opening and closing an intake valve or exhaust valve (2) and arranged concentrically with and rotatable around the camshaft (11) and for rotation relative to the camshaft (11); a first pin member (17,23) slidably fitted at one end thereof in the first groove portion (16A) and connected at opposite end thereof to the camshaft (11) so that rotation of the camshaft (11) is transmitted to the intermediate rotating member (16); a second pin member (18,24) slidably fitted at one end thereof in the second groove portion (16B) and connected at opposite end thereof to the cam lobe (12) so that rotation of the intermediate rotating member (16) is. transmitted to the camshaft (11); and eccentric position adjusting means (30) for rotating the eccentric member (14) in accordance with a state of operation of the internal combustion engine.

6 Claims, 16 Drawing Sheets

VARIABLE VALVE DRIVING MECHANISM

DESCRIPTION

1. Technical Field

This invention relates to a variable valve driving mechanism for controlling opening and closing of an intake valve and exhaust valve of an internal combustion engine at timings corresponding to a state of operation of the engine, and especially to a variable valve driving mechanism making use of a nonuniform speed coupling which can produce an output while retarding a rotational speed of input rotation.

2. Background Art

There are reciprocating valves drivenly opened and closed by a cam, for example, like an intake valve and exhaust valve (which may hereinafter be collectively called "engine valves") arranged in a reciprocating internal combustion engine (hereinafter referred to as an "engine"). Such valves are driven so that they are lifted in accordance with the profile and phase of rotation of a cam.. Accordingly, such timings of opening and closing of each valve and its open period (a quantity representing a period, in which the valve is maintained open, in terms of the unit of an angle of rotation of a crankshaft) also depend on the profile and phase of rotation of the cam.

In the case of an intake valve and exhaust valve arranged in an engine, the optimal timings of their opening and closing and their open periods vary in accordance with a state of loading on the engine and a state of its speed. A variety of mechanisms have therefore been proposed to make it possible to vary the timings of opening and closing of such valves and their open periods.

For example, mechanisms have been developed and put into practical use, which selectively use a cam having a cam profile for high speeds and a cam having a cam profile for low speeds so that valves are opened and closed selectively at valve opening and closing timings and for open periods suited to times of high speeds and to times of low speeds, respectively.

Further, techniques where a nonuniform speed coupling making use of an eccentric mechanism is interposed between a cam and a camshaft and that, while rotating the cam relative to the camshaft via the nonuniform speed coupling, the cam is caused to rotate at a speed different from the camshaft to permit adjusting the timings of opening and closing of valves and their open periods in accordance with a state of operation of an engine have been proposed, for example, in U.S. Pat. No. 3,633,555 [Japanese Patent Publication (Kokoku) No. SHO 47-20654, hereinafter referred to as "the first conventional art"] and G.B. Patent No. 2,268,570 [Japanese Patent Application Laid-Open (Kokai) No. HEI 4-183905, hereinafter referred to as "the second conventional art"].

For example, FIG. 16 and FIG. 17 disclose a variable valve timing camshaft mechanism according to U.S. Pat. No. 3,633,555 (the first conventional art) as published in SAE Technical Paper Series 880387. This mechanism is designed to permit changing of the valve timing by using a nonuniform speed coupling. In FIG. 22 and FIG. 23, designated by numerals 101 and 102 are a camshaft and a cam, respectively, and the cam 102 is arranged to be able to rotate concentrically with the camshaft 101 and relative to the camshaft 101. Between this camshaft 101 and this cam 102, a nonuniform speed coupling 103 is also interposed.

The nonuniform speed coupling 103 is provided with a collar 105 connected to the camshaft 101 via a locking screw

103 for integral rotation with the camshaft 101, an intermediate member 108 connected to the cam 102 via a drive pin 106 and slider 107 for integral rotation with the cam 102, and a drive pin 109 and slider 110 for transmitting rotation from the collar 105 to the intermediate member 108, and further with a rotation control sleeve 111 with the collar 105 and intermediate member 108 accommodated therein and a control shaft 112 for adjusting the phase of rotation of the rotation control sleeve 111.

The sliders 107,110 are accommodated slidably in a radial directions in elongated grooves 108A,108B of the intermediate member 108, respectively, so that rotation of the camshaft 101 is transmitted from the collar 105 of the nonuniform speed coupling 103 to the intermediate member 108 via the drive pin 109 and slider 110, and further to the cam 102 via the slider 107 and drive pin 106.

Incidentally, the collar 105 and intermediate member 108 are rotatably supported so that they can freely rotate within the rotation control sleeve 111 with their respective outer peripheries 105A,108C maintained in sliding contact with an inner periphery 111A of the rotation control sleeve 111. A rotational center $O_2$ of the outer periphery 108C of the intermediate member 108 and the inner periphery 111A of the rotation control sleeve 111 is eccentric relative to an axis (rotational center) $O_1$ of the camshaft 101.

Upon transmission of rotation of the camshaft 101 to the intermediate member 108 via the drive pin 109 and slider 110, the drive pin 109 and slider 110 rotate integrally with the collar 105 about the rotational center $O_1$, while the intermediate member 108 rotationally driven via these drive pin 109 and slider 110 rotates about the rotational center $O_2$. Accordingly, the slider 107 and drive pin 106 to which rotation is transmitted from the intermediate member 108 are not coincided in rotation with the camshaft 101, and rotate at a nonuniform speed.

The state shown in FIG. 17 can be schematically illustrated into a state that, as shown in FIG. 18, the drive pin 109 and the drive pin 106 are located at a point $P_1$ and a point $P_3$, respectively. As the drive pin 109 (namely, the point $P_1$) progressively rotates in a clockwise direction (see arrow A) from the above state, the intermediate member 108 rotates exactly through $\theta_1$ ($=90°-\theta_2$, $\theta_2>0$) about the center $O_2$ when the drive pin 109 has rotated through 90° about the center $O_1$ and has reached a point $P_2$.

Accordingly, the drive pin 106 rotates exactly through $\theta_3$ ($=90°-\theta_4$) about the center $O_1$ and reaches a point $P_4$. Since the rotational angle $\theta_3$ of the drive pin 106 is smaller than 90° as described above, the speed of rotation of the drive pin 106 during this rotation is slower than that of the drive pin 109.

Further, while the drive pin 109 rotates from the pin $P_2$ to the point $P_3$ through further 90° about the center $O_1$, the intermediate member 108 rotates exactly through $\theta_5$ ($=90°+\theta_2$) about the center $O_2$. The drive pin 106 therefore reaches the point $P_1$ after rotating exactly through $\theta_5$ ($=90°+\theta_4$) about the center $O_1$. As the angle of rotation of the drive pin 106 during this rotation is greater than 90°, the speed of rotation of the drive pin 106 is faster than that of drive pin 109.

While the drive pin 109 rotates from the point $P_3$ to a point $P_5$ through 90° about the center $O_1$, the intermediate member 108 rotates exactly through $\theta_5$ ($=90+\theta_2$) about the center $O_2$ The drive pin 106 therefore rotates exactly through $\theta_5$ ($90°+\theta_4$) about the center $O_1$ and reaches a point $P_6$. Because the rotational angle of the drive pin 107 during this rotation is greater than 90°, the speed of rotation of the drive pin 106 is faster than that of the drive pin 109.

In addition, while the drive pin 109 rotates from the point $P_5$ to the point $P_1$ through 90° about the center $O_1$, the intermediate member 108 rotates exactly through $\theta_1$ (=90°-$\theta_2$) about the center $O_2$. The drive pin 106 therefore rotates exactly through $\theta_3$ (=90°-$\theta_4$) about the center $O_1$ and reaches the point $P_3$. Since the rotational angle $\theta_3$ of the drive pin 106 during this rotation is smaller than 90°, the speed of rotation of the drive pin 106 is slower than that of the drive pin 109.

As is understood from the foregoing, the speed of rotation of the drive pin 106 which rotates integrally with the cam 102 becomes faster and slower than that of the drive pin 109 which rotates integrally with the camshaft 101, so that the drive pin 106 rotates at nonuniform speeds relative to the speed of rotation of the drive pin 109. The cam 102 therefore does not rotate at a uniform speed even if the camshaft 101 rotates at a uniform speed.

Changes in the speed of the cam 102 relative to the phases of rotation of the camshaft 101 correspond to positions of the center $O_2$ of the intermediate member 108 relative to the center $O_1$ of the camshaft 101. The control shaft 112 is connected so that it can drive the rotation control sleeve 111 via a gear mechanism 113. Upon rotation of the control shaft 112, the rotation control sleeve 111 therefore rotates so that the position of the rotational center $O_2$ of its inner periphery 111A (namely, the center of the intermediate member 108) moves.

According to a variable valve gear making use of a nonuniform speed coupling and constructed as described above, setting, for example, in such a way that the cam 102 is advanced than the camshaft 101 near the opening of the intake valve and the cam 102 is retarded than the camshaft 101 near the closing of the intake valve makes the opening timing of the intake valve earlier so that the valve open period becomes longer. Valve drive control suited for the time of high speeds of the internal combustion engine can hence be realized.

As a still further variable valve timing camshaft mechanism of the nonuniform speed coupling type, a technique disclosed in Japanese Patent Application Laid-Open (Kokai) No. HEI 5-202718 (hereinafter referred to as "the third conventional art") has also been developed. This technique relates to an intake valve drive control apparatus for an internal combustion engine and is constructed as shown in FIG. 19 and FIG. 20.

In FIG. 19 and FIG. 20, designated by numerals 221 and 222 are a drive shaft and a camshaft, respectively. The camshaft 222 is arranged on an outer periphery of the drive shaft 221 so that it can rotate concentrically with the drive shaft 221 (about a rotational center X) and relative to the drive shaft 221. This camshaft 222 is provided with a cam 226. Between the drive shaft 221 and the camshaft 222, a nonuniform speed coupling 220 is arranged to cause the camshaft 222 to rotate at nonuniform speeds. There are also shown an intake valve 223, a valve spring 224, and a valve lifter 225. The intake valve 223 is biased toward an open side by the valve spring 224 and, when pushed by the cam 226 via the valve lifter 225, is openingly driven against the valve spring 224.

The nonuniform speed coupling 220 is provided with a flange portion 227 formed at an end portion of the camshaft 222, a sleeve 228 integrally rotatable with the drive shaft 221, a flange portion 232 formed at an end portion of the sleeve 228, and an annular disk 229 interposed between both the flange portions 227 and 232; and is constructed so that a rotational center Y of this annular disk 229 is eccentric relative to the rotational center X of the drive shaft 221.

Pins 236,237 are disposed on opposite sides of the annular disk 229, respectively, so that they extend out from the corresponding sides. They are maintained in engagement with engaged grooves 230,233 formed in the flange portions 227,232,. respectively, so that rotation of the drive shaft 221 is transmitted from the flange portion 232 of the sleeve 228, by way of the engaged groove 233, the pin 237, the annular disk 229, the pin 236 and the engaged groove 230 and then from the flange portion 227, to the camshaft 222. When the rotational center Y of the annular disk 229 is eccentric relative to the rotational center X of the drive shaft 221 at this time, the speed of rotation of the annular disk 229 becomes faster and slower relative to the drive shaft 221 as in the mechanism shown in FIG. 16 and FIG. 17 as explained with reference to FIG. 18. At this time, the pins 236,237 move in the engaged grooves 230,233, respectively, while maintained in sliding contact therewith.

According to this construction, the center of the annular disk 229 is pivotal about a pin 238. Namely, a control ring 235 which rotatably supports the annular disk 229 thereon is arranged on an outer periphery of the annular disk 229. This control ring 235 is pivotal about the pin 238 and on a side opposite to the pin 238, is provided with a lever portion 235b so that the lever portion projects out from the control ring. This lever portion 235b is driven by a drive mechanism 239 so that the center Y of the annular disk 229 is positionally adjusted. In this apparatus, the degree of a speed change of the cam 226 relative to the drive shaft 221 can therefore be adjusted by changing the eccentricity.

Incidentally, the drive mechanism 239 is constructed so that the lever portion 235b is driven by a hydraulic piston 242. Numeral 245 indicates a return spring against the hydraulic piston 242.

In this mechanism, opposite side wall portions 236*a*,236*b*, 237*a*,237*b* of the pins 236,237, said opposite side wall portions being maintained in sliding contact with the engaged grooves 230,233, are formed flat so that wearing of the pins 236,237 due to their sliding movements can be reduced.

As a still further variable valve timing camshaft mechanism of the nonuniform speed coupling, a technique of Japanese Patent Application Laid-Open (Kokai) No. HEI 3-168309 or the like has also been developed.

In each conventional variable valve driving mechanism for an internal combustion engine, said variable valve driving mechanism making use of a nonuniform speed coupling of such an eccentric mechanism as mentioned above, the construction of the eccentric mechanism, specifically an eccentric member such as the rotation control sleeve 11 in the first conventional art, the eccentric sleeve in the unillustrated second conventional art (see numeral 51 in its specification) or the control ring 235 in the third conventional art is arranged on an outer periphery of a member (hereinafter referred to as an "intermediate rotating member") called the intermediate member 109, the drive member (see numeral 36 in the specification of the second conventional art) or the annular disk 229. The nonuniform speed coupling therefore has a large outer diameter, resulting in a variable valve driving mechanism having a large overall size as a system.

Namely, there is a limitation imposed on an attempt to arrange, for example, the drive pins 106,109 and sliders 107,110 in the first conventional art or the pins 236,237 in the third conventional art as close as possible to the center of rotation. Arrangement of an eccentricity-adjusting mechanism on an outermost side of a nonuniform speed coupling therefore leads to an unavoidable increase in the outer diameter of the nonuniform speed coupling. This results in the problem that the overall system becomes large.

As a technique for overcoming such a problem, it has been proposed to arrange an eccentric member on an outer periphery of a camshaft and to dispose an intermediate rotating member on an outer periphery of this eccentric member [Japanese Patent Application Laid-Open (Kokai) No. HEI 5-118208, hereinafter referred to as "the fourth conventional art"].

However, the technique of this fourth conventional art [Japanese Patent Application Laid-Open (Kokai) No. HEI 5-118208] is of the construction that the intermediate rotating member is rotatably supported merely on the eccentric member alone. At the time of a start-up of an engine, the intermediate rotating member therefore tends to incline in the direction of a deviation of its axis (in a direction that its rotary axis inclines). There is accordingly the potential problem that twisting may take place especially between the intermediate rotating member and the eccentric member, thereby possibly failing to permit a sure operation of the intermediate rotating member and impairing start-up performance of an engine.

With the foregoing problems in view, the present invention has as an object thereof the provision of a variable valve driving mechanism which is constructed to permit a reduction in the size of an overall system while preventing tilting of an intermediate rotating member, which tilting would otherwise tend to occur at the time of a start-up, and hence improving start-up performance.

DISCLOSURE OF THE INVENTION

To achieve the above-mentioned object, a variable valve driving mechanism according to the present invention comprises a camshaft rotatably driven by a crankshaft of an internal combustion engine; an eccentric member having an annular eccentric portion, which is eccentric relative to the camshaft, and rotatably arranged on an outer periphery of the camshaft; an intermediate rotating member defining therein a first groove portion and second groove portion, which extend in radial directions, and rotatably supported on the eccentric portion; a cam lobe having a cam portion for opening and closing a valve member, which regulates an inducted-air-charging period or an exhaust-gas-discharging period of a combustion chamber of the internal combustion engine, and arranged for rotation relative to the camshaft; a first pin member slidably fitted at one end thereof in the first groove portion and connected at an opposite end thereof to the camshaft so that rotation of the camshaft is transmitted to the intermediate rotating member; a second pin member slidably fitted at one end thereof in the second groove portion and connected at an opposite end thereof to the cam lobe so that rotation of the intermediate rotating member is transmitted to the camshaft; and eccentric position adjusting means for rotating the eccentric member in accordance with a state of operation of the internal combustion engine so that an eccentric position of the eccentric portion is adjusted.

Owing to the construction as described above, when the camshaft is drivenly rotated by the crankshaft of the engine, the rotation of the camshaft is transmitted to the intermediate rotating member via the first pin member and the first groove portion of the intermediate rotating member and further, from the intermediate rotating member to the cam lobe via the second groove portion of the intermediate rotating member and the second pin member, whereby the cam portion of the cam lobe opens and closes the valve member while being caused to turn.

The intermediate rotating member is rotatably supported on the eccentric portion and is eccentric relative to the camshaft. Upon transmission of rotation of the camshaft to the intermediate rotating member, the rotation of the camshaft is therefore transmitted to the intermediate rotating member while, corresponding to the eccentricity of the intermediate rotating member, the first pin member slides in the first groove portion, in other words, in a state that a loading point where a load is transmitted from the camshaft to the intermediate rotating member is located inside the intermediate rotating member.

Upon transmission of rotation of the intermediate rotating member to the cam lobe, the rotation of the intermediate rotating member is transmitted to the cam lobe while, corresponding to the eccentricity of the intermediate rotating member, the second pin member slides in the second groove portion, in other words, in a state that a loading point where a load is transmitted from the intermediate rotating member to the cam lobe is located inside the intermediate rotating member.

In this manner, via the first pin member, the intermediate rotating member and the second pin member, the cam lobe rotates in advance and retardation relative to rotation of the camshaft in accordance with an eccentric position of the eccentric portion while the inclination in the direction of the deviation of the axis of the intermediate rotating member is limited at the intermediate rotating member. The rotation of the cam lobe thus becomes nonuniform in speed even when the camshaft rotates at a uniform speed. The timings of opening and closing of the cam portion arranged on the cam lobe are also advanced and retarded depending on the eccentric position of the eccentric portion.

Because such an eccentric position of the eccentric portion is adjusted by the eccentric position adjusting means in accordance with the state of operation of the internal combustion engine, the operation timing of the cam portion can be advanced or retarded by this adjustment of the eccentric position so that the driving timing of the valve can be controlled.

As a result, the inducted-air-charging period or exhaust-gas-discharging period of the internal combustion engine can be adjusted in accordance with the state of operation of the internal combustion engine.

Further, the arrangement of the intermediate rotating member on the outer periphery of the eccentric portion has the advantage that the outer periphery around the eccentric portion can be reduced to permit a size reduction in the overall system.

The cam lobe is arranged on the outer periphery of the camshaft, and this camshaft and this cam lobe rotate relative to each other. This relative rotation takes place only as little as a change of the cam lobe in phase relative to the camshaft produced by the eccentricity of the engaging members and is extremely slight compared with the speeds of rotation of the cam lobe and camshaft. Wearing due to the sliding contact between the cam lobe and the camshaft is therefore limited to an extremely small degree.

Of course, the adjustment of the eccentric position can be conducted by way of the eccentric member rotatably supported on the outer periphery of the camshaft. Each cylinder can therefore be provided with the eccentric member even in the case of an internal combustion engine having a multiplicity of cylinders in the longitudinal direction of the camshaft, thereby bringing about the advantage that the present driving mechanism can be applied to all types of engines led by various types of in-series multicylinder engines.

Preferably, a mounting portion extending toward the eccentric member along a rotary axis of the camshaft is formed at an end portion of the cam lobe, an arm member which is integral with the camshaft and extends in a radial direction of the camshaft is disposed within a space other than the mounting portion between the cam lobe and the eccentric member, the opposite end of the first pin member is rotatably connected to the arm member, and the opposite end of the second pin member is rotatably connected to the mounting portion, and axes of the first and second pin members are set in parallel with the rotary axis.

This construction has the advantage that the overall system can be reduced in size.

It is also preferred that the intermediate rotating member faces the end portion of the cam lobe and that the cam lobe is provided with a contact portion which is maintained in contact with one side wall of the intermediate rotating member to limit tilting of the intermediate rotating member in the direction of an axis deviation.

According to this construction, the tilting of the intermediate rotating member in the direction of the axis deviation, said tilting tending to take place at the time of a start-up or the like, is limited by the contact portion. The intermediate rotating member can always smoothly rotate even at the time of a start-up or the like, thereby bringing about the advantage that the reliability of the apparatus is enhanced.

It is also preferred that a bearing is interposed at least between the eccentric member and the intermediate rotating member.

This construction permits smooth sliding between the eccentric member and the intermediate rotating member and also smooth sliding between the camshaft and the eccentric member. By this apparatus, a load on the starting system of the internal combustion engine, said load tending to occur at the time of a start-up, and the burden of drive force by the eccentric position adjusting means upon adjustment of the eccentric position can be reduced, thereby making it possible to decrease the start-up torque of the engine and the eccentric position adjusting torque. There is accordingly the advantage that small-capacity actuators can be used as actuators of these start-up system and eccentric position adjusting means.

To achieve the above-mentioned object, another variable valve driving mechanism according to the present invention comprises a camshaft rotationally driven by a crankshaft of an internal combustion engine; an eccentric member having an annular eccentric portion, which is eccentric relative to the camshaft, and rotatably arranged on an outer periphery of the camshaft; an intermediate rotating member rotatably supported on the eccentric portion; a cam lobe having a cam portion for opening and closing a valve member, which regulates an inducted-air-charging period or an exhaust-gas-discharging period of a combustion chamber of the internal combustion engine, and arranged for rotation relative to the camshaft; a contact portion formed on one of the camshaft and the cam lobe so that the contact portion is maintained in contact with one side wall of the intermediate rotating member to limit tilting of the intermediate rotating member in the direction of an axis deviation; a first pin member connected slidably in a radial direction at one end thereof to one of the camshaft and the intermediate rotating member and connected at an opposite end thereof to the other one of the camshaft and the intermediate rotating member so that rotation of the camshaft is transmitted to the intermediate rotating member; a second pin member connected slidably in a radial direction at one end thereof to one of the intermediate rotating member and the cam lobe and connected at an opposite end thereof to the other one of the camshaft and the intermediate rotating member so that rotation of the intermediate rotating member is transmitted to the cam lobe; and eccentric position adjusting me ans for rotating the eccentric member in accordance with a state of operation of the internal combustion engine so that an eccentric position of the eccentric portion is adjusted.

Owing to the construction as described above, when the camshaft is drivenly rotated by the crankshaft of the engine, the rotation of the camshaft is transmitted to the intermediate rotating member vi a the first pin member and further, from the intermediate rotating member to the cam lobe via the second pin member as mentioned above, whereby the cam portion of the cam lobe opens a nd closes the v alve member while being caused to turn.

The intermediate rotating member is rotatably supported on the eccentric portion and is eccentric relative to the camshaft. Upon transmission of rotation of the camshaft to the cam lobe, the cam lobe is advanced and retarded via the first pin member, the intermediate rotating member and the second pin member relative to the camshaft in accordance with an eccentric position of the eccentric portion. The timings of opening and closing of the cam portion arranged on the cam lobe are also advanced or retarded corresponding to the eccentric position of the eccentric portion.

Because the eccentric position of the eccentric portion is adjusted by the eccentric position adjusting means in accordance with the state of operation of the internal combustion engine, the operation timing of the cam portion can be advanced or retarded by this adjustment of the eccentric position so that the driving timing of the valve can be controlled.

As a result, the inducted-air-charging period or exhaust-gas-discharging period of the internal combustion engine can be adjusted in accordance with the state of operation of the internal combustion engine. In addition, there is an advantage such that the outer periphery around the eccentric portion can be reduced to permit a size reduction in the overall system.

According to this construction, the tilting of the intermediate rotating member in the direction of the axis deviation, said tilting tending to take place at the time of a start-up or the like, is limited by the contact portion. The intermediate rotating member can always smoothly rotate even at the time of a startup or the like, thereby bringing about the advantage that the reliability of the apparatus is enhanced.

To achieve the above-mentioned object, a further variable valve driving mechanism according to the present invention comprises a camshaft rotationally driven by a crankshaft of an internal combustion engine an eccentric member having an annular eccentric portion, which is eccentric relative to the camshaft, and rotatably arranged on an outer periphery of the camshaft; an intermediate rotating member rotatably supported on the eccentric portion; a cam lobe having a cam portion for opening and closing a valve member, which regulates an inducted-air-charging period or an exhaust-gas-discharging period of a combustion chamber of the internal combustion engine, and arranged for rotation relative to the camshaft; a first pin member connected slidably in a radial direction at one end thereof to one of the camshaft and the intermediate rotating member and connected at an opposite end thereof to the other one of the camshaft and the intermediate rotating member so that rotation of the camshaft is transmitted to the intermediate rotating member; a second pin member connected slidably in a radial direction at one end thereof to one of the intermediate rotating member and the cam lobe and connected at an opposite end thereof to the other one of the camshaft and the intermediate rotating member so that rotation of the intermediate rotating member is transmitted to the cam lobe; eccentric position adjusting means for rotating the eccentric member in accordance with a state of operation of the internal combustion engine so that an eccentric position of the eccentric portion is adjusted; and a bearing interposed at least one of between the eccentric member and the intermediate rotating member and between the camshaft and the eccentric member.

Owing to the construction as described above, when the camshaft is drivenly rotated by the crankshaft of the engine, the rotation of the camshaft is transmitted to the intermediate rotating member via the first pin member and further, from the intermediate rotating member to the cam lobe via the second pin member as mentioned above, whereby the cam portion of the cam lobe opens and closes the valve member while being caused to turn.

The intermediate rotating member is rotatably supported on the eccentric portion and is eccentric relative to the camshaft. Upon transmission of rotation of the camshaft to the cam lobe, the cam lobe is advanced and retarded via the first pin member, the intermediate rotating member and the second pin member relative to the camshaft in accordance with an eccentric position of the eccentric portion. The timings of opening and closing of the cam portion arranged on the cam lobe are also advanced or retarded corresponding to the eccentric position of the eccentric portion.

Because the eccentric position of the eccentric portion is adjusted by the eccentric position adjusting means in accordance with the state of operation of the internal combustion engine, the operation timing of the cam portion can be advanced or retarded by this adjustment of the eccentric position so that the driving timing of the valve can be controlled.

As a result, the inducted-air-charging period or exhaust-gas-discharging period of the internal combustion engine can be adjusted in accordance with the state of operation of the internal combustion engine. In addition, there is an advantage such that the outer periphery around the eccentric portion can be reduced to permit a size reduction in the overall system.

As the bearing is interposed at least one of between the eccentric member and the intermediate rotating member and between the camshaft and the eccentric member, sliding between the eccentric member and the intermediate rotating member or sliding between the camshaft and the eccentric member can be smoothly conducted. By this apparatus, a load on the starting system of the internal combustion engine, said load tending to occur at the time of a start-up, and the burden of drive force by the eccentric position adjusting means upon adjustment of the eccentric position can be reduced, thereby making it possible to decrease the start-up torque of the engine and the eccentric position adjusting torque. There is accordingly the advantage that small-capacity actuators can be used as actuators of these start-up system and eccentric position adjusting means.

It is possible to interpose a bearing between the eccentric portion and the intermediate rotating member and also another bearing between the camshaft and the eccentric portion. However, when a reduction in the number of parts, components and the like, a reduction in cost and the like are taken into consideration, it is preferred to interpose a bearing only between the eccentric portion and the intermediate rotating member.

BEST MODES FOR CARRYING OUT THE INVENTION

Figure 9:
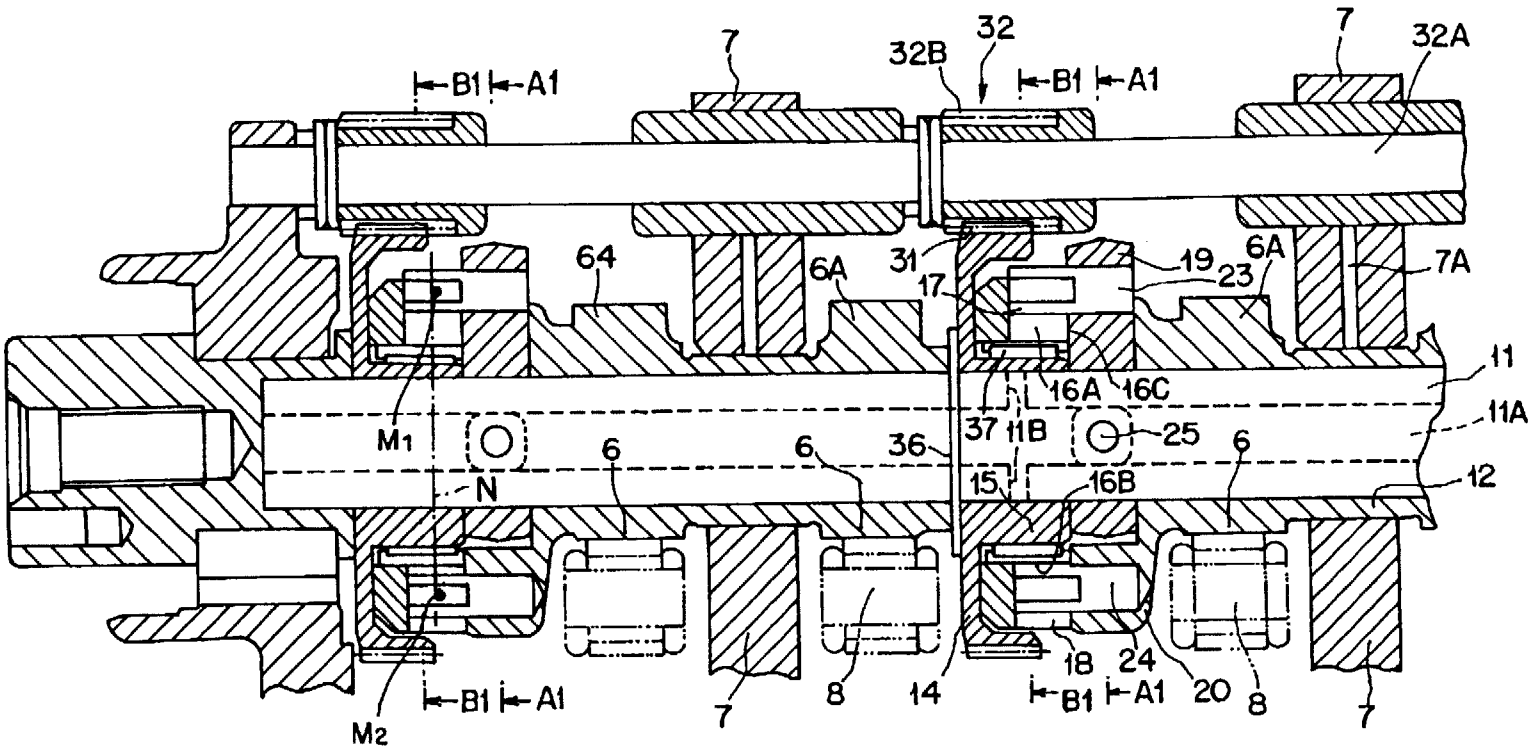
FIG. 9 is a schematic cross-sectional view of an internal combustion engine, depicting a variable valve driving mechanism according to a second embodiment of the present invention.
Figure 10:
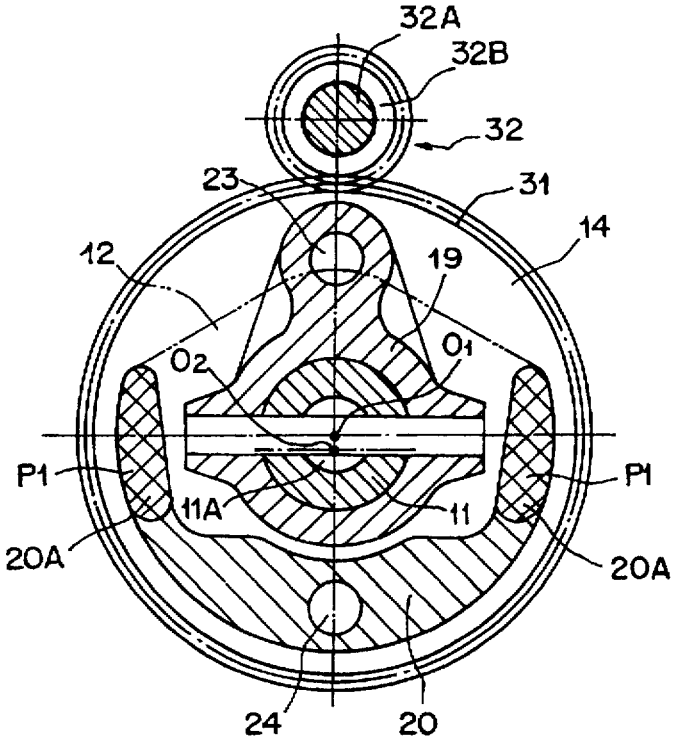
FIG. 10 is a cross-sectional view showing the variable valve driving mechanism according to the second embodiment of the present invention, and is a cross-sectional view taken in the direction of arrows A1—A1 of FIG. 9.
Figure 11:
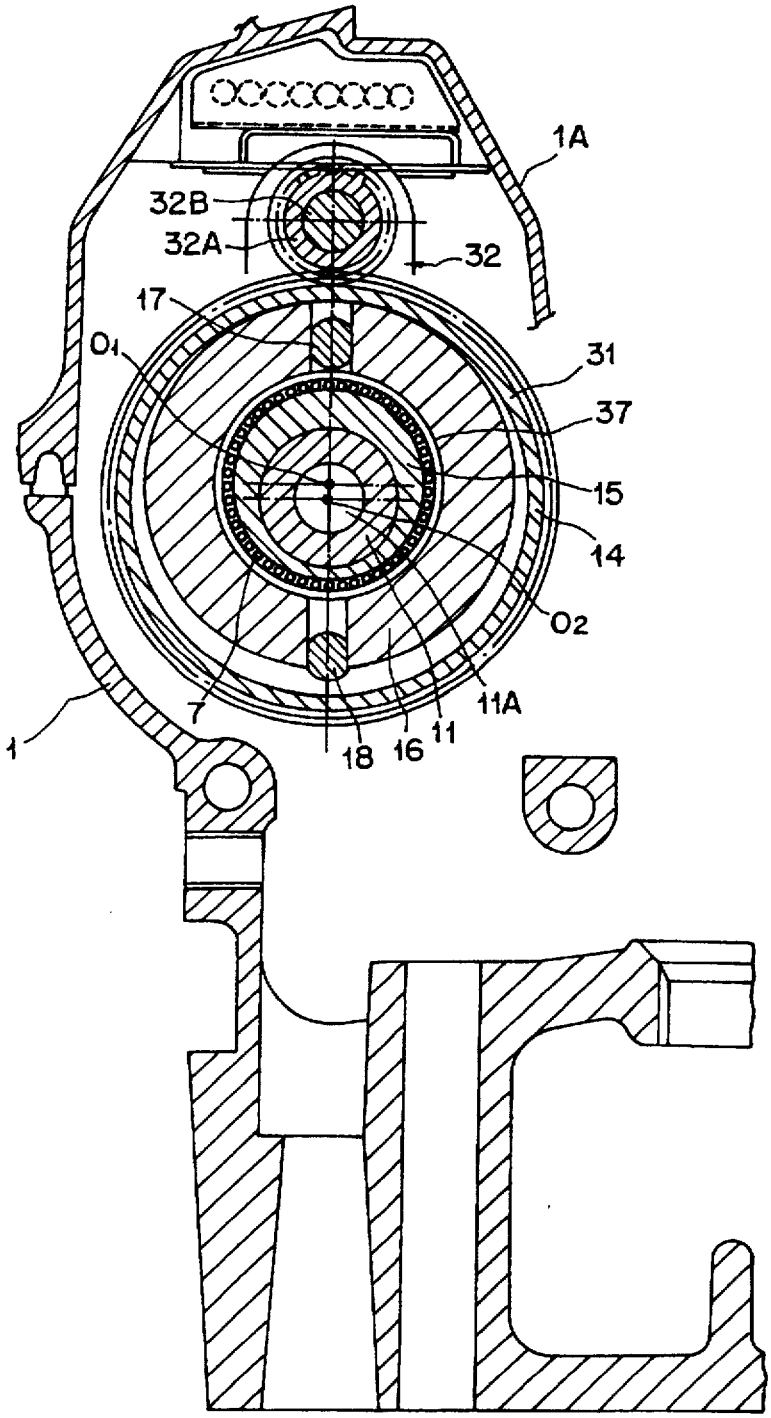
FIG. 11 is a cross-sectional view showing the variable valve driving mechanism according to the second embodiment of the present invention, and is a cross-sectional view taken in the direction of arrows B1—B1 of FIG. 9.
Figure 12:
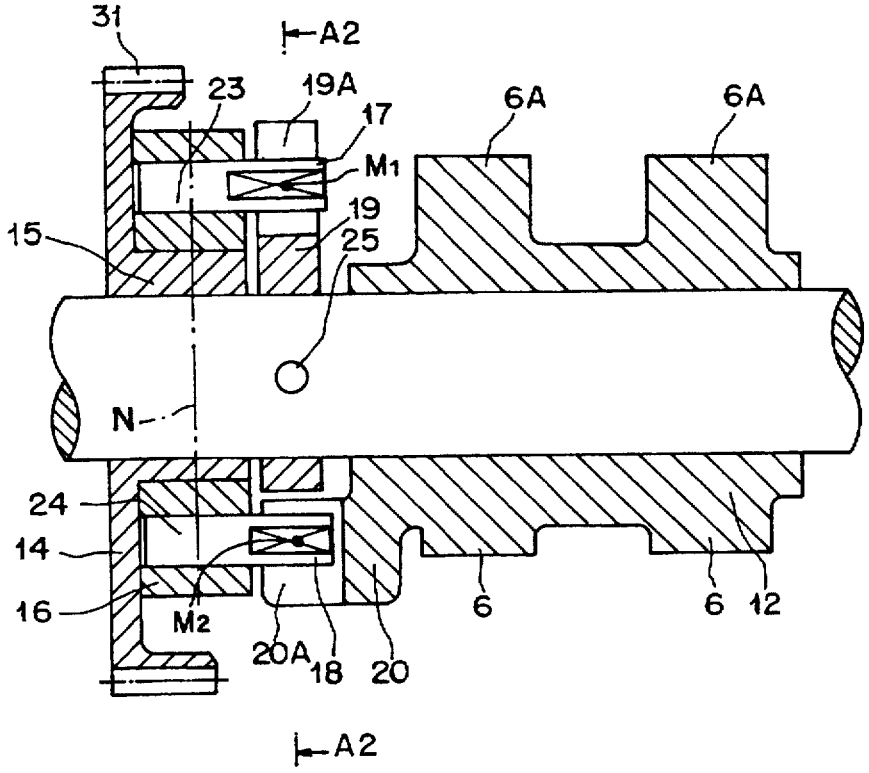
FIG. 12 is a reference view for describing prevention of tilting of a nonuniform speed coupling in the first and second embodiments, and is a schematic cross-sectional view of a comparative example of the first and second embodiments.

With reference to the drawings, the embodiments of the present invention will hereinafter be described. FIG. 1 through FIG. 8 illustrate the variable valve driving mechanism as the first embodiment of the present invention, FIG. 9 through FIG. 11 show the variable valve driving mechanism as the second embodiment of the present invention, and FIG. 12 through FIG. 15 are the reference views for describing the preventing of tilting of the nonuniform speed coupling in the present invention.

Firstly, describing about the first embodiment, the internal combustion engine which relates to this embodiment is a reciprocating internal combustion engine, and the variable valve driving mechanism is arranged to drive an intake valve or exhaust valve (hereinafter collectively called the "valve") disposed in an upper part of a cylinder.

Figure 1:
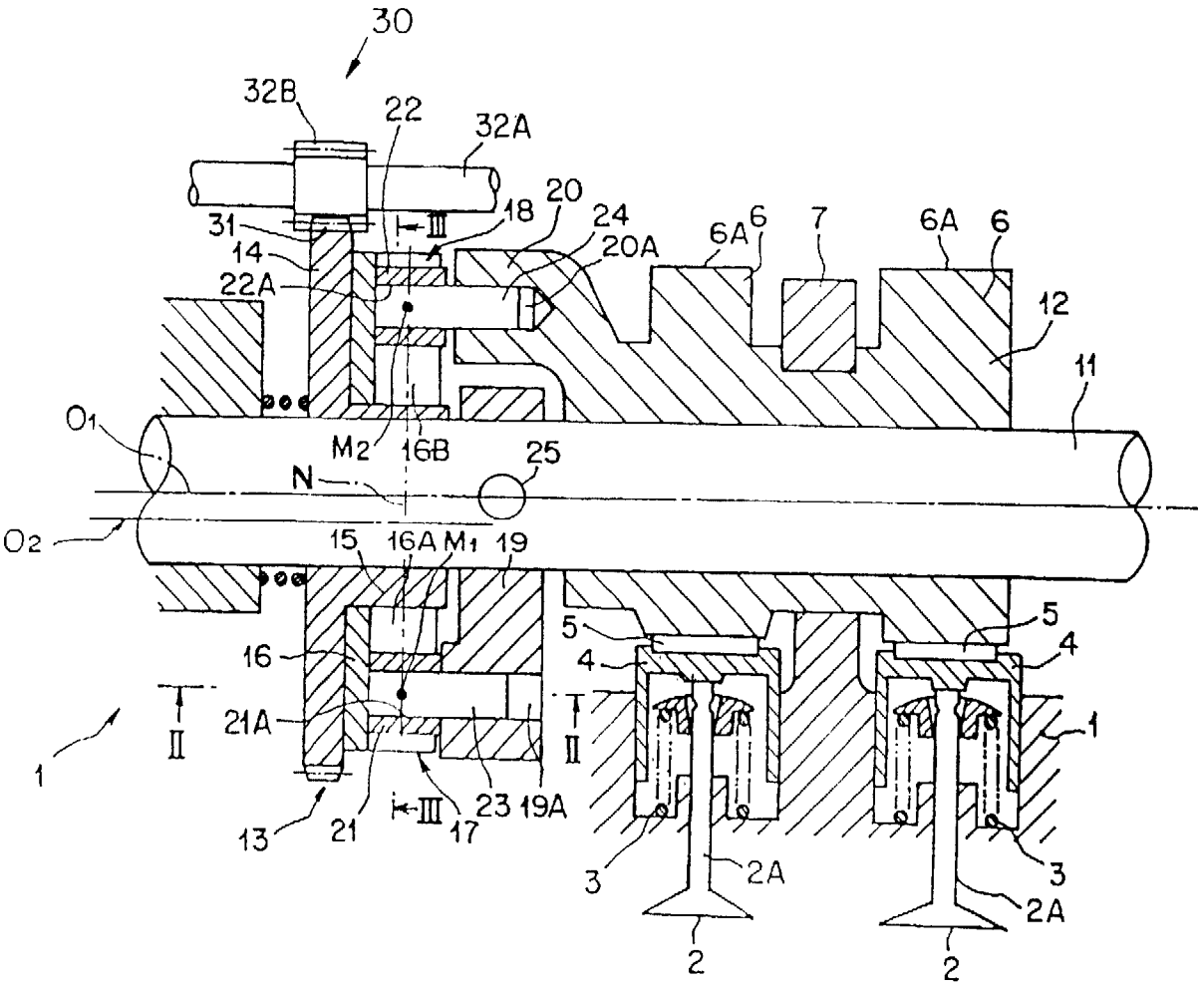
FIG. 1 is a schematic cross-sectional view of an internal combustion engine, showing a variable valve driving mechanism according to a first embodiment of the present invention.

FIG. 1 is the cross-sectional view illustrating an essential part of a cylinder head provided with the variable valve driving mechanism. As is illustrated in FIG. 1, the cylinder head 1 is equipped with the valve 2 to open or close an unillustrated intake port or exhaust port. A valve spring 3 is arranged on an end portion 2A of a stem of the valve 2 so that the valve 2 is biased toward a closing side. Further, a tappet 4 is applied to the end portion 2A of the stem of the valve 2, and a cam 6 is maintained in contact with a shim 5 on the tappet 4, whereby the valve 2 is driven in an opening direction by a raised portion 6A of the cam 6 against biasing force of the valve spring 3. The variable valve driving mechanism is arranged to cause the cam 6 to turn.

The variable valve driving mechanism is provided, as shown in FIG. 1, with a camshaft 11, which is rotatedly driven in association with a crankshaft (not shown) of the engine, and a cam lobe 12 arranged on an outer periphery of the camshaft 11. The cam (cam portion) 6 is arranged on an outer periphery of the cam lobe 12 so that the cam extends out from the outer periphery. The outer periphery of the cam lobe 12 is rotatably supported by a journal bearing 7 arranged on a side of the cylinder head 1. Further, a nonuniform speed coupling 13 is disposed between the camshaft 11 and the cam lobe 12.

This nonuniform speed coupling 13 is provided with a control disk (eccentric member) 14 supported for rotation on the outer periphery of the camshaft 11, an eccentric portion 15 arranged integrally with the control disk 14, an engaging disk 16 disposed as an intermediate rotating member on an outer periphery of the eccentric portion 15, and a first slider member 17 and second slider member 18 connected to the engaging disk 16.

Figure 3:
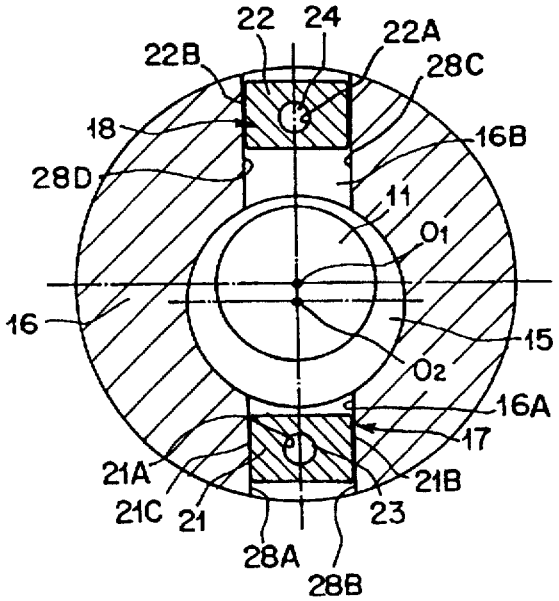
FIG. 3 is a cross-sectional view showing a nonuniform speed coupling in the variable valve driving mechanism according to the first embodiment of the present invention, and is a cross-sectional view taken in the direction of arrows III—III of FIG. 1.

As is illustrated in FIG. 1 and FIG. 3, the eccentric portion 15 has a rotational center (rotary axis) $O_2$ at a position offset from a rotational center (rotary axis) $O_1$ of the camshaft 11, and the engaging disk 16 is arranged to rotate about the rotational center $O_2$ of this eccentric portion 15.

Figure 2:
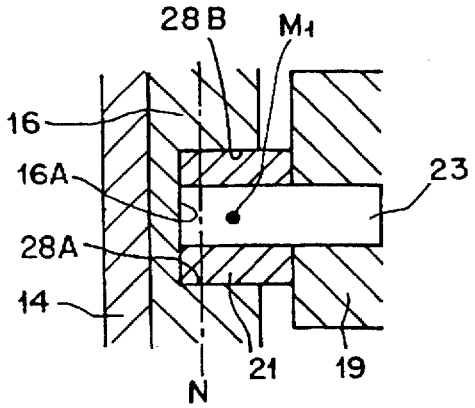
FIG. 2 is a cross-sectional view showing the variable valve driving mechanism according to the first embodiment of the present invention, and is a cross-sectional view taken in the direction of arrows II—II of FIG. 1.

In one side of the engaging disk 16, a slider groove 16 as a first groove portion and a slider grove 16B as a second groove portion are formed in radial directions as illustrated in FIG. 1 through FIG. 3. In this embodiment, the two slider grooves 16A,16B are arranged on the same diameter so that they are offset in the phase of rotation through 1800 from each other. The camshaft 11 is provided with a drive arm 19 as an arm member, to and with which the first slider member making up a first pin member is connected and engaged. On the hand, the cam lobe 12 is provided with an arm portion 20, to and with which the second slider member 18 making up a second pin member is connected and engaged.

Of these, the drive arm 19 is arranged within a space other than the arm portion 20 between the cam lobe 12 and the control disk 14 so that the drive arm 19 extends out in a radial direction from the camshaft 11. The drive arm is connected with the camshaft 11 by a lock pin 25 so that they rotate integrally. On the other hand, the arm portion 20 is formed integrally with the cam lobe 12 so that an end portion of the cam lobe extends in a radial direction to a position located close to the one side of the engaging disk 16.

The first slider member 17 and second slider member 18 are provided with slider main bodies 21,22, which are arranged slidably in radial directions in the slider grooves 16A,16B of the engaging disk 16, and also with drive pins 23,24 which are accommodated at one end portions thereof in bores 19A,20A of the drive arm 19 and arm portion 20 and at opposite end portions thereof in bores 21A,22A of the slider main bodies 21,22 to make up the first and second members and which have axes set in parallel with each other and alongside an axis of the camshaft 11. These drive pins 23,24 are connected to one or both of the bores 19A,20A of the drive arm 19 and arm portion 20 and the bores 21A,22A of the slider main bodies 21,22 so that they can turn on their axes.

In the nonuniform speed coupling 13, rotation of the camshaft 11 is therefore transmitted from the drive arm 19 to the engaging disk 16 via the bore 19A, the drive pin 23, the bore 21A, the slider main body 21 and the groove 16A and further, from the arm portion 20 to the cam lobe 12 via the groove 16B, the slider main body 22, the bore 22A, the drive pin 24 and the bore 20A.

Between the slider main body 21 and the groove 16A, rotating force is transmitted between outer side walls 21B, 21C of the slider main body 21 and inner walls 28A,28B of the groove 16A. Between the groove 16B and the slider main body 22, rotating force is transmitted between inner walls 28C,28D of the groove 16B and outer side walls 22B,22C of the slider main body 22.

Upon transmitting rotation as described above, because of the eccentricity of the engaging disk 16, the engaging disk 16 is repeatedly advanced and retarded relative to the camshaft 11 and the cam lobe 12 is repeatedly advanced and retarded relative to the engaging disk 16, so that the cam lobe 12 rotates at speeds not equal to the camshaft 11.

The principle of rotation is substantially the same as that already described under the Background Art with reference to FIG. 24 and based on FIG. 5(A) through FIG. 5(D), a description will now be made about the phases of rotation of the engaging disk 16 and cam lobe 12 so that their phases of rotation correspond to the individual phases of rotation of the camshaft (camshaft angles).

Figure 5A:
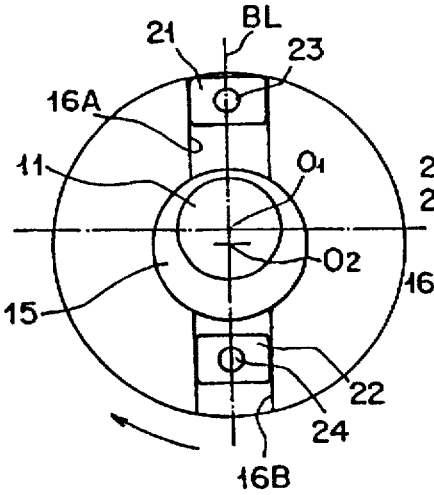
FIG. 5(A) through FIG. 5(D) are all crosssectional views showing an operation of a nonuniform speed mechanism in the variable valve driving mechanism according to the first embodiment of the present invention.

Namely, as is illustrated in FIG. 5(A), employed as a standard (camshaft angle=0 deg) is a state where a central axis of the drive pin 23 is located at an upper position on a straight line (correctly, a plane) BL connecting the rotational center $O_1$ of the camshaft 11 and the rotational center $O_2$ of the engaging disk 16 with each other and a central axis of the drive pin 24 is located at a lower position on the straight line (plane) BL. Assuming that the camshaft 11 rotates clockwise from this state as indicated by an arrow in FIG. 5(A), a discussion will next be made.

Figure 5B:
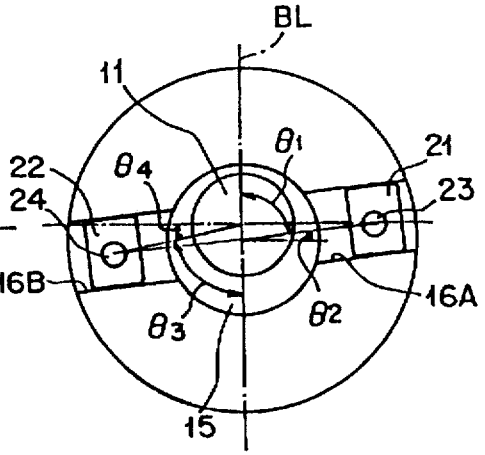

As mentioned above, rotation of the camshaft 11 is successively transmitted from the drive arm 19 to the engaging disk 16 via the bore 19A, the drive pin 23, the bore 21A, the slider main body 21 and the groove 16A. When the camshaft 11 rotates for example through 90 degree (=right angle) about its rotational center $O_1$ and the camshaft angle becomes 90° ("deg" which indicates an angle will hereinafter be referred to by using "°"), the drive pin 23 assumes such a position as shown in FIG. 5(B).

Since the rotational center $O_2$ of the engaging disk 16 is offset relative to the rotational center $O_1$ of the camshaft 11 (in this embodiment, downwardly offset in the drawing), the centers of the drive pin 23 and slider main body 21 at this time have rotated through 90° relative to the rotational center $O_1$ of the camshaft 11 but relative to the rotational center $O_2$ of the engaging disk 16, have a rotation quantity $\theta_1$ (=90°−$\theta_2$) smaller by an angle $\theta_2$ than 90°.

Concurrently with this, rotation of the engaging disk 16 is successively from the arm portion 20 to the cam lobe 12 via the groove 16B, the slider main body 22, the bore 22A, the drive pin 24 and the bore 20A. Because the rotation quantity of the drive pin 24 and slider main body 22 about the rotational center $O_2$ of the engaging disk 16 is equal to the rotation quantity of the drive pin 23 and slider main body 21 about the rotational center $O_2$ of the engaging disk 16, the rotation quantity of the drive pin 24 and slider main body 22 about the rotational center $O_2$ of the engaging disk 16 is $\theta_1$. Further, a rotation quantity $\theta_3$ of the drive pin 24 and the slider main body 22 about the rotational center $O_1$ of the cam lobe 12 will be considered. This rotation quantity $\theta_3$ can be expressed as shown by the next formula and is still smaller than the rotation quantity $\theta_1$ about the rotational center $O_2$ of the engaging disk 16.

$$\theta_3=90°-\theta_4,\ \text{where}\ \theta_4\sim 2\theta_2$$

Accordingly, while the camshaft 11 rotates through 90° about its rotational center $O_1$ from a camshaft angle of 0° to a camshaft angle of 90°, the cam lobe 12 rotates through the rotation quantity $\theta_3$ smaller than 90° about its rotational center $\theta_1$. During this period, the cam lobe 12 therefore rotates at a lower speed than the camshaft 11.

Namely, at the camshaft angle of 0°, the cam lobe 12 is in the same phase of rotation as the camshaft 11. As the camshaft angle increases from this angle, the cam lobe 12 is increasingly retarded in the phase of rotation relative to the camshaft 11 and its phase of rotation is most retarded at the camshaft angle of 90°.

Figure 5C:
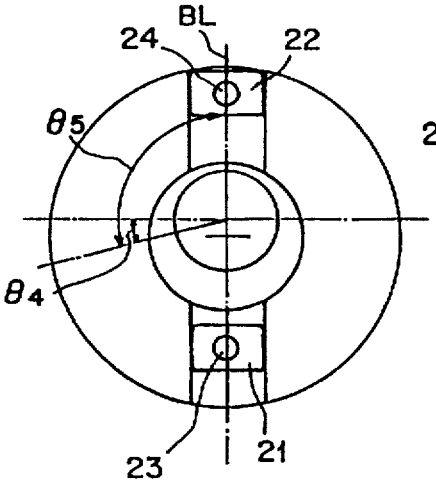

When the camshaft 11 further rotates through 90° about its rotational center $O_1$ from the camshaft angle of 90° to a camshaft angle of 180°, the drive pin 23 then assumes such a position as shown in FIG. 5(C).

When the drive pin 23 reaches the position shown in FIG. 5(C), the central axis of the drive pin 24 is located at an upper position on the straight line BL and the central axis of the drive pin 23 is located at a lower position on the straight line B1. The phase of rotation of the camshaft 11 and that of the cam lobe 12 are therefore coincided with each other.

During this period, that is, while the camshaft rotates from the state of the camshaft angle of 90° shown in FIG. 5(B) to the state of the camshaft angle of 180° illustrated in FIG. 5(C), the camshaft 11 rotates exactly through 90° while the cam lobe 12 rotates exactly through the rotation quantity $\theta_5$ expressed by the following formula so that during this period, the cam lobe 12 rotates at a higher speed than the camshaft 11.

$$\theta_5=180°-\theta_3=90°+\theta_4$$

Namely, the cam lobe 12 is most retarded in the phase of rotation relative to the camshaft 11 at the camshaft angle of 90° but, as the camshaft angle increases from 90° to 180°, the retard of its phase of rotation gradually decreases and its phase of rotation becomes equal to that of the camshaft 11 at the camshaft angle of 180°.

Figure 5D:
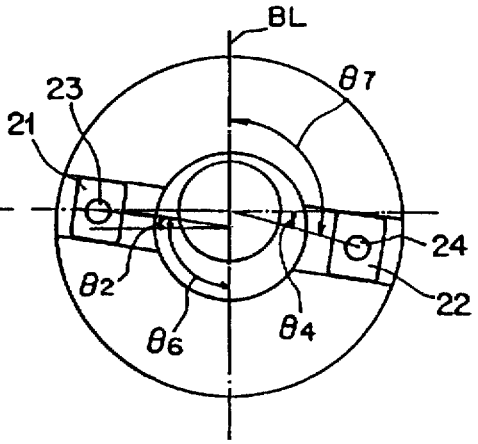

When the camshaft 11 rotates further about its rotational center $O_1$ exactly through 90° from the camshaft angle of 180° to a camshaft angle of 270°, the drive pin 23 then assumes such a position as shown in FIG. 5(D).

When the drive pin 23 reaches the position shown in FIG. 5(D), the drive pin 23 and the slider main body 21 have rotated, in contrast to the state shown in FIG. 5(B), through 90° about the rotational center $O_1$ of the camshaft 11 but through a rotation quantity $\Delta_6$ (=90°+$\theta_2$) greater by the angle $\theta_2$ than 90° about the rotational center $O_2$ of the engaging disk 16. Accordingly, the rotation quantity of the drive pin 24 and slider main body 22 about the rotational center $O_2$ of the engaging disk 16 becomes $\theta_6$, and the rotation quantity of the drive pin 24 and the slider main body 22 about the rotational center $O_1$ of the cam lobe 12 becomes $\theta_7$. This rotation quantity 07 can be expressed as shown by the next formula and becomes still greater than the rotation quantity $\theta_6$ about the rotational center $O_2$ of the engaging disk 16.

$$\theta_7=90°+\theta_4=\theta_5$$

During this period, namely, while the state changes from FIG. 5(C) to FIG. 5(D), the camshaft 11 rotates exactly through 90° while the cam lobe 12 rotates exactly through the rotation quantity $\theta_{7i}$ expressed by the above formula. During this period, the cam lobe 12 therefore rotates at a higher speed than the camshaft 11.

In other words, the cam lobe 12 is in the same phase of rotation as the camshaft 11 at the camshaft angle of 180° and, as the camshaft angle increases from this angle, the cam lobe 12 is increasingly advanced in the phase of rotation relative to the camshaft 11. The phase of rotation of the cam lobe 12 is most advanced at the camshaft angle of 270°.

When the camshaft 11 rotates further about the rotational center $O_1$ exactly through 90° from the camshaft angle of 270° to a camshaft angle 360° (=0°), the drive pin 23 again assumes such a position as shown in FIG. 5(A).

When the drive pin 23 reaches the position shown in FIG. 5(A), the central axis of the drive pin 23 is located at the upper position on the straight line BL and the central axis of the drive pin 24 is located at the lower position on the straight line B1. The phase of rotation of the camshaft 11 and that of the cam lobe 12 therefore coincides with each other.

During this period, that is, while the state changes from FIG. 5(D) to FIG. 5(A), the camshaft 11 rotates exactly through 900 while the cam lobe 12 rotates exactly through a rot ation quantity $\theta_8$ (now shown) expressed by the following formula. During this p eriod, the cam lobe 12 rotates at a lower speed than the camshaft 11.

$$\theta_8=180°-\theta_7=90°-\theta_4=\theta_3$$

Namely, the cam lobe 12 was most advanced in the phase of rotation relative to the camshaft 11 at the camshaft angle of 270° and, as the camshaft angle increases from 270° to 360°, the advance of its phase of rotation gr adually decreases. The phase of r otation of the cam lobe becomes equal to that of the camshaft 11 at the camshaft angle of 360°.

Figure 8:
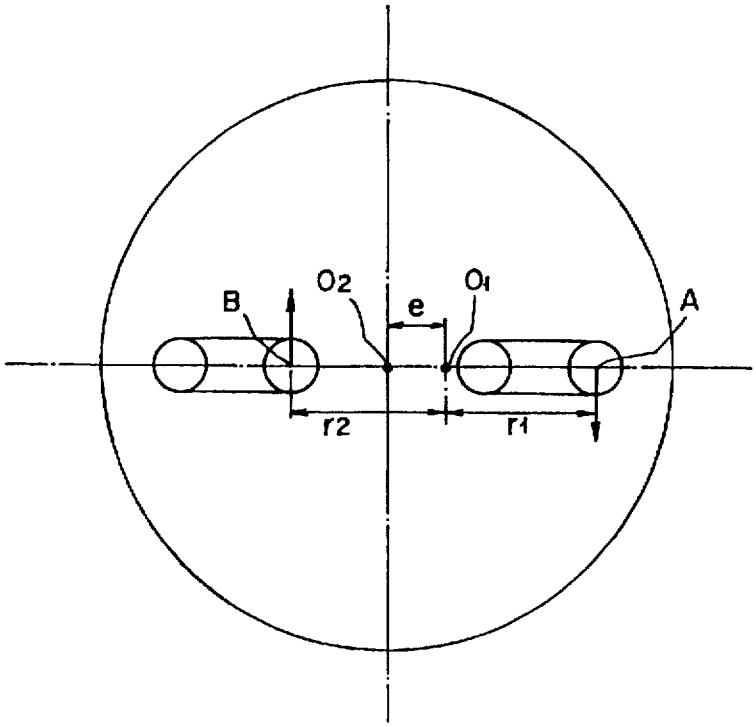
FIG. 8 is a schematic diagram for describing about the nonuniform speed mechanism in the variable valve driving mechanism according to the first embodiment of the present invention.

Further, a relationship between the speed of rotation of the camshaft 11 and that of the cam lobe 12, for example, in the state shown in FIG. 5(A), can be expressed as follows:

Tangential speed at the center, point A, of the drive pin 23$=r_1\cdot\omega_1$ Angular speed about the eccentric central axis $O_2$ at point A$=[r_1/(r_1+e)]\cdot\omega_1$ Tangential speed at the center, point B, of the drive pin 24$=[r_1/(r_1+e)]\cdot\omega_1\cdot(r_2-e)$ when assumed that, as is illustrated in FIG. 8, the distance between the drive pin 23 on the side of the camshaft 11 (driving side) and the rotational center $O_1$ of the camshaft 11 is $r_1$, the distance between the drive pin 24 on the side of the cam lobe 12 (driven side) and the rotational center $O_1$ of the camshaft 11 is $r_2$, the distance between the rotational center $O_1$ of the camshaft 11 and the rotational center $O_2$ of the engaging disk 16 is e, and the speed of rotation of the camshaft 11 (=the angular speed of the drive pin 23) is $\omega_1$.

An angular speed of the cam lobe 12 (=an angular speed of the cam 6) can hence be defined as follow:

$$\omega_2=[r_1/(r_1+e)]\cdot\omega_1\cdot(r_2-e)\cdot(1/r_2)=(r_1/r_2)\cdot[(r_2-e)/(r_1+e)]\cdot\omega_1$$

Assuming $r_1=r_2=r$, the angular speed $\omega 2$ of the cam lobe 12 can therefore be expressed as follow:

$$\omega_2=[(r_2-e)/(r_1+e)]\cdot\omega_1$$

It is therefore understood that, when e>0 [the state shown in FIG. 5(A)], $\omega_2<\omega_1$ and the cam lobe 12 rotates at a lower speed than the camshaft 11.

Figure 6:
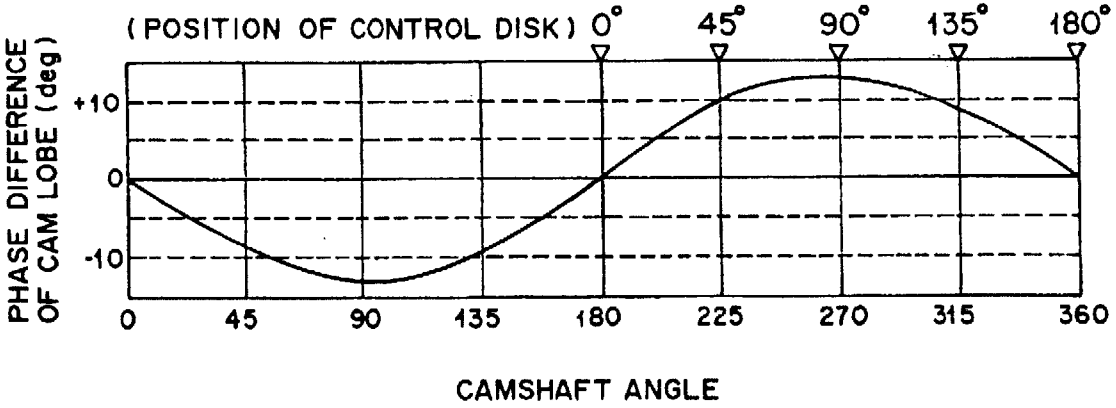
FIG. 6 is a characteristic diagram for describing about the nonuniform speed mechanism in the variable valve driving mechanism according to the first embodiment of the present invention.

As has been described above, the cam lobe 12 is advanced and retarded relative to the camshaft 11 and rotates at speeds not equal to the speed of rotation of the camshaft 11, and phase changes of the cam lobe 12 relative to the camshaft 11 can be shown as a waveform resembling a sinusoidal wave as shown in FIG. 6. In FIG. 6, camshaft angles corresponding to the description of FIG. 5(A) to FIG. 5(D) are plotted along the abscissa, and phase differences of the cam lobe 12 relative to the camshaft 11 are plotted along the ordinate and each phase difference in advance of the camshaft 11 is set in the positive direction.

Using the characteristic that the cam lobe 12 is advanced or retarded relative to the camshaft 11 as described above, the opening and closing timings of the valve can be adjusted. For example, if the cam lobe 12 is advanced relative to the camshaft 11 in the neighborhood of the opening timing of the valve 2, the opening timing of the valve 2 can be advanced. If the cam lobe is retarded relative to the camshaft 11, the opening timing of the valve 2 can be retarded. On the other hand, if the cam lobe 12 is advanced relative to the camshaft 11 in the neighborhood of the closing timing of the valve 2, the closing timing can be advanced. If the cam lobe 12 is retarded relative to the camshaft 11, the closing timing of the valve 2 can be retarded.

Figure 4:
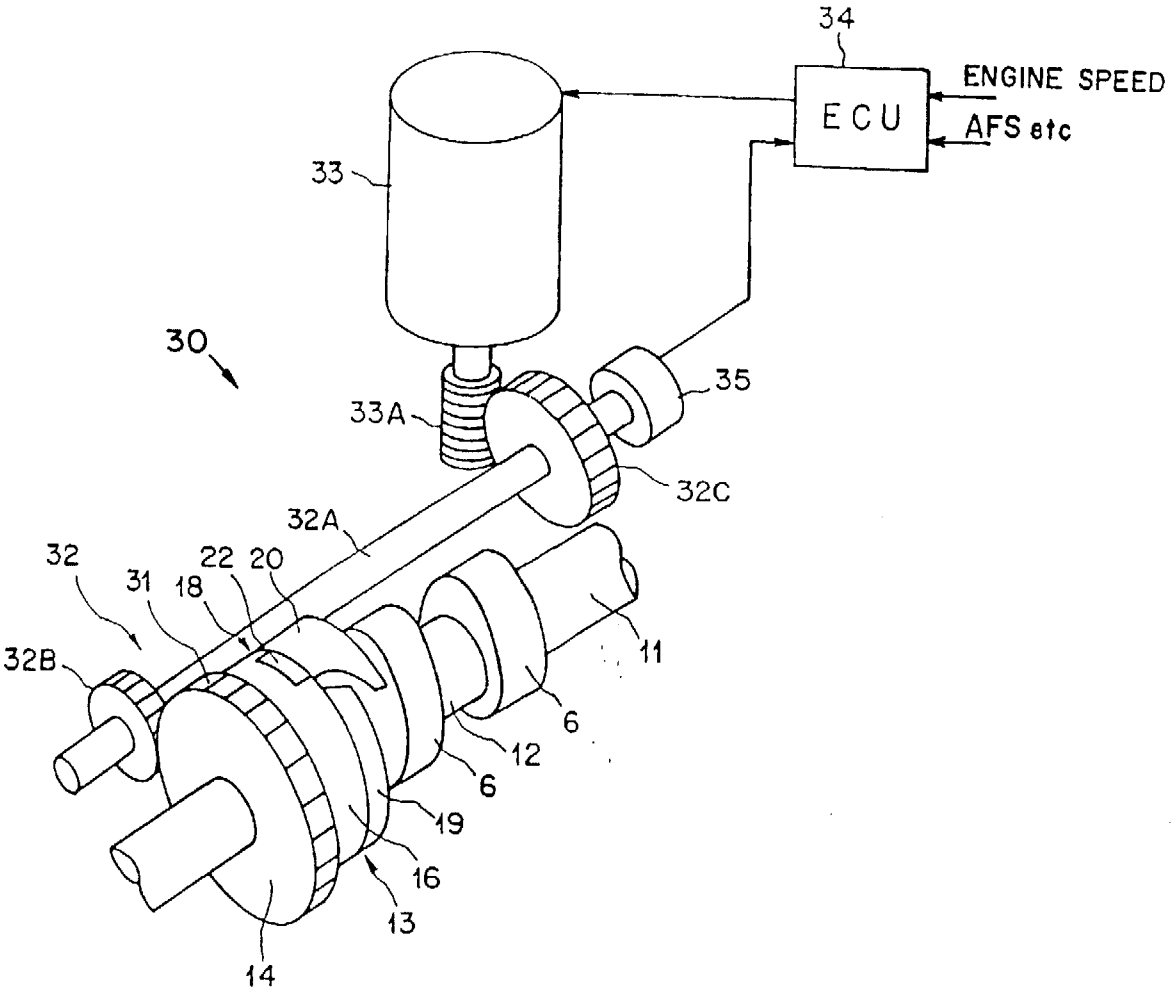
FIG. 4 is a schematic perspective view primarily illustrating an eccentric position adjusting mechanism (control means) in the variable valve driving mechanism according to the first embodiment of the present invention.

The degree of such a phase deviation of the cam lobe 12 relative to the camshaft 11 can be adjusted by changing the position of the eccentric center $O_2$ of the eccentric portion 15 which is arranged integrally with the control disk 14. To conduct a phase adjustment with respect to the eccentric portion 15, the present apparatus is therefore provided, as shown in FIG. 1 and FIG. 4, with an eccentric position adjusting mechanism 30 for adjusting the eccentric position by rotating the control disk (eccentric member) 14.

This eccentric position adjusting mechanism 30 is provided with a gear mechanism 32, which rotates the control disk 14 via a first gear 31 formed on the outer periphery of the control disk 14, and an electric motor 33 as drive means for driving the gear mechanism 32. The gear mechanism 32 is constructed of a gear shaft 32A arranged in parallel with the camshaft 11, a second gear (control gear) 32B arranged on the gear shaft 32A and maintained in mesh with the first gear 31, and a third gear 32C maintained in mesh with a gear 33A arranged on a rotating shaft of the motor 33. Incidentally, the rotating shaft of the motor 33 is in a twisted relationship with the gear shaft 32A, and the third gear 32C and the motor-side gear 33A are constructed as a worm gear mechanism so that the third gear 32C is arranged as a worm wheel and the motor-side gear 33A is arranged as a worm gear.

The motor 33 is controlled by an electronic control unit (ECU) 34 as control means. Namely, ECU 34 controls an operation of the motor 33 on the basis of a detection signal from a position sensor 35 so that the phase of rotation of the control disk 14 is set in a desired state. In this embodiment, the position sensor 35 is arranged at an end portion of the gear shaft 32A to facilitate the arrangement, and the phase of rotation of the control disk 14 is detected from the state of the phase of rotation of the gear shaft 32A.

When the phase of rotation (position) of the control disk 14 is changed as described above, the state of the phase difference of the cam lobe relative to the camshaft changes.

The characteristic diagram of phase differences of the cam lobe shown in FIG. 6 corresponds to the state of eccentricity which changes depending on the camshaft angle as shown in FIG. 5(A) through FIG. 5(D). Taking the phase of rotation of the control disk 14 at this time as a base value (namely, the phase of rotation of the control disk 14=0°), the value of the phase difference of the cam lobe relative to the camshaft angle shifts as the phase of rotation of the control disk 14 varies, for example, to 45°, 90°, 135° and 180°.

In an upper part of FIG. 6, 0°, 45°, 90°, 135° and 180° are shown. They are to convert each angle on the abscissa in accordance with the corresponding position (phase of rotation) of the control disk 14, and the position where each angle of the control disk 14 is shown indicates the position of the camshaft angle of 180° at the control disk angle.

Namely, when the position of the control disk 14 is at 0°, the abscissa gradation of the camshaft angle of 180° is plotted as shown in FIG. 6. When the position of the control disk 14 changes to 45°, the abscissa gradation of the camshaft angle of 180° shifts to the position which indicates this "45°" (the position of "225°" in FIG. 6). Further, when the position of the control disk 14 reaches 90°, the abscissa gradation of the camshaft angle of 180° shifts to the position which indicates this "90°" (the position of "270°" in FIG. 6).

Further, when the position of the control disk 14 reaches 135°, the abscissa gradation of the camshaft angle of 180° shifts to the position which indicates this "135°" (the position of "315°" in FIG. 6) and, when the position of the control disk 14 reaches 180°, the abscissa gradation of the camshaft angle of 180° shifts to the position which indicates this "180°" (the position of "360°" in FIG. 6).

When the position of the control disk 14 is adjusted as described above, the lifted state of the valve also varies. Namely, when the position of the control disk is set to cause a top of the raised portion 6A of the cam 6 to act on the valve 2 at the camshaft angle of 0° as illustrated in FIG. 5(A) and further when the characteristics of phase changes of the cam lobe 12 relative to the camshaft 11 are set as shown in FIG. 5(A) through FIG. 5(D) and FIG. 6, the lifted state of the valve has characteristics as indicated by a curve Ll in FIG. 7.

Namely, when the phase of rotation of the control disk 14 is 0° and the cam lobe 12 operates as shown in FIG. 5(A) through FIG. 5(D), the cam lobe is brought into a state most retarded in phase at the camshaft angle of 90° and from the camshaft angle of 0° to the camshaft angle of 180°, the cam lobe 12 produces a phase retard relative to the camshaft 11. On the other hand, the cam lobe is brought into a state most advanced in phase at the camshaft angle of 270° and from the camshaft angle of 180° to the camshaft angle of 360°, the cam lobe 12 produces a phase advance relative to the camshaft 11. In other words, centering around the camshaft angle of 0° where the valve lift becomes the maximum, the phase of the cam lobe 12 is advanced before the camshaft angle of 0° (where the camshaft angle is negative) and is retarded after 0° (where the camshaft angle is positive). The lifted state of the valve therefore has such characteristics as indicated by a curve L5 in FIG. 7.

When the phase of rotation of the control disk 14 is adjusted to 45°, the characteristics of the phase difference of the cam lobe vary so that the cam lobe is brought into a state most retarded in phase at the camshaft angle of 45°. Compared with the case where the phase of rotation of the control disk 14 is 0°, the phase advance of the cam lobe 12 when the camshaft angle is before 0° (the camshaft angle is negative) is reduced, and the phase retard of the cam lobe 12 when the camshaft angle is after 0° (the camshaft angle is positive) is also reduced. Accordingly, the lifted state of the valve has such characteristics as indicated by a curve L4 in FIG. 7.

Further, when the phase of rotation of the control disk 14 is adjusted to 90°, the characteristics of the phase difference of the cam lobe vary further. The cam lobe is brought into a stage most retarded in phase at the camshaft angle of 0° and compared with the case where the phase of rotation of the control disk 14 is 45°, the phase advance of the cam lobe 12 when the camshaft angle is before 0° (the camshaft angle is negative) is reduced, and the phase retard of the cam lobe 12 when the camshaft angle is after 0° (the camshaft angle is positive) is also reduced. Accordingly, the lifted state of the valve has such characteristics as indicated by a curve L3 in FIG. 7.

Figure 7:
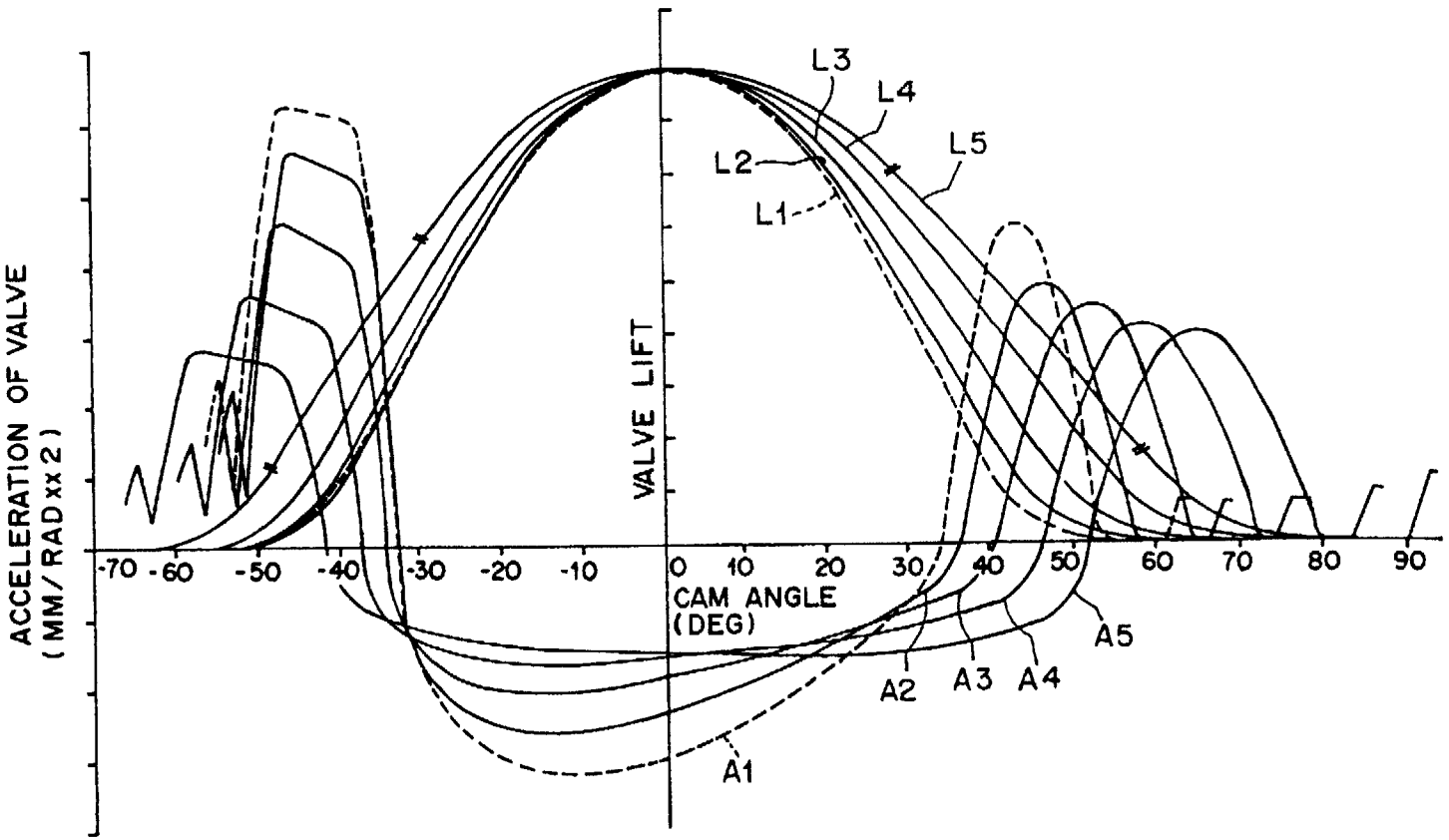
FIG. 7 is a diagram showing valve lift characteristics as adjusted in eccentric position by the variable valve driving mechanism according to the first embodiment of the present invention.

Likewise, when the phase of rotation of the control disk 14 is adjusted to 135° or 180°, the lifted state of the valve has such characteristics as indicated by a curve L2 or L1 in FIG. 7.

Acceleration characteristics of the valve corresponding to the valve lift characteristics L1 to L5 can be as indicated by curves Al to A5, respectively, in FIG. 7.

In particular, the variable valve driving mechanism is designed so that detection information (engine speed information) from the engine speed sensor (not shown), detection information (AFS information) from an air flow sensor (not shown), and the like are inputted to ECU 34. Control of the motor 33 in the eccentric position adjusting mechanism 30 is performed based o these information, that is, in accordance with the speed and load of the engine.

Namely, when the engine is at a high speed or under a high load, the phase of rotation of the control disk 14 is adjusted to have, for example, valve lift characteristics like the curve L4 or L5 in FIG. 7, so that the variable valve driving mechanism is controlled to make longer the open period of the valve. On the other hand, when the engine is at a low speed or under a low load, the phase of rotation of the control disk 14 is adjusted to have, for example, valve lift characteristics like the curve Ll or L2 in FIG. 7, so that the variable valve gear is controlled to make shorter the open period of the valve.

As the variable valve driving mechanism according to the first embodiment of the present invention is constructed as described above, the valve opening characteristics are controlled while adjusting the phase of rotation of the control disk 14 via the eccentric position adjusting mechanism 30.

Namely, at ECU 34, the phase of rotation of the control disk 14 is set in accordance with a speed and load of the engine on the basis of engine speed information, AFS information and the like and, while controlling an operation of the motor 33, the control disk 14 is driven based on a detection signal from the position sensor 35 so that the actual phase of rotation of the control disk 14 is brought into a preset state.

Assume, for example, that the phase of rotation of the control disk 14 is in the state shown in FIG. 5(A) through FIG. 5(D) (namely, 0°). While the camshaft 11 undergoes a full turn, the cam lobe 12 equipped with the cam 6 produces a phase retard relative to the camshaft 11 as shown in FIG. 5(A) through FIG. 5(C) and FIG. 6 in a camshaft angle range of from 0° to 180° and especially, produces the greatest phase regard at the camshaft angle of 90°. In a camshaft range of from 180° to 360°, on the other hand, the cam lobe 12 produces a phase advance relative to the camshaft 11 as shown in FIG. 5(C) through FIG. 5(A) and FIG. 6 and especially, products the greatest phase advance at the camshaft angle of 270°.

As a consequence, the valve has such lift characteristics that, as indicated by the curve L5 in FIG. 7, the timing of opening is early and the timing of closing is late, in other words, the valve open period is long.

As the phase of rotation of the control disk 14 is gradually advanced form example from 0°, the valve opening timing and closing timing become gradually later and earlier, respectively, in the order of the curves L4, L3, L2 and Ll in FIG. 7 so that the open period of the valve becomes gradually shorter.

According to the above variable valve driving mechanism, through control of an operation of the motor by ECU 34 and, for example, with the curve L3 shown in FIG. 7 as a center, the valve open period is made longer like the curves L4 and L5 in FIG. 7 as the engine speed and/or the engine load becomes higher and conversely, the valve open period is made shorter like the curves L2 and Ll in FIG. 7 as the engine speed and/or engine load becomes lower.

In this manner, valve driving suited to the state of operation of the engine can be performed while controlling the phase of rotation (position) of the control disk 14 in accordance with the state of operation of the engine. Especially, the lift characteristics of the valve can be continuously adjusted so that the driving of the valve can always be conducted with characteristics optimal for the state of operation of the engine.

Next, concerning the feature that the nonuniform speed coupling 13 of the above variable valve driving mechanism is constructed to prevent the engaging disk 16 from tilting in the direction of its axis deviation, the comparative example of the first embodiment is illustrated in FIG. 12 through FIG. 15 and with reference to these drawings, a description will be made about this feature. Incidentally, this comparative example is different from the first embodiment in the construction of some parts of the nonuniform speed coupling 13, namely, in the formed positions of the slider grooves (the first and second groove portions) 16A,16B, the arranged position of the slider members 17,18, etc. Members identical or equivalent to the corresponding members in the first embodiment are designated by like signs.

Described specifically, the pin members 23,24 are rotatably supported on the drive arm (arm member) 19 on the side of the camshaft 11 and the arm portion (mounting portion) 20 on the side of the cam lobe 20 in the first embodiment, whereas the pin members 23,24 are both rotatably supported on the engaging disk (intermediate rotating member) 16 in this comparative example.

Conversely, the slider members 17,18 are connected slidably in radial directions to the drive arm (arm member) 19 on the side of the camshaft 11 and the arm portion (mounting portion) 20 on the side of the cam lobe 12.

Figure 15:
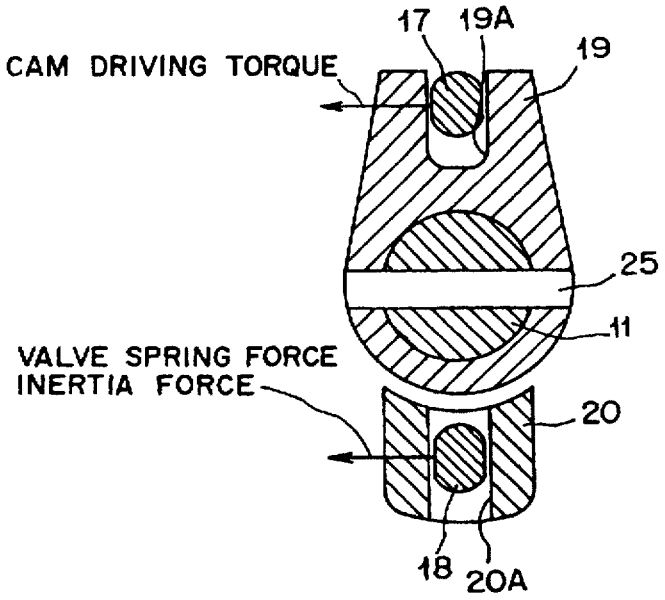
FIG. 15 is a reference view for describing the prevention of tilting of the nonuniform speed coupling in the first and second embodiments, and is a cross-sectional view taken in the direction of arrows A2—A2 of FIG. 12.
Figure 16:
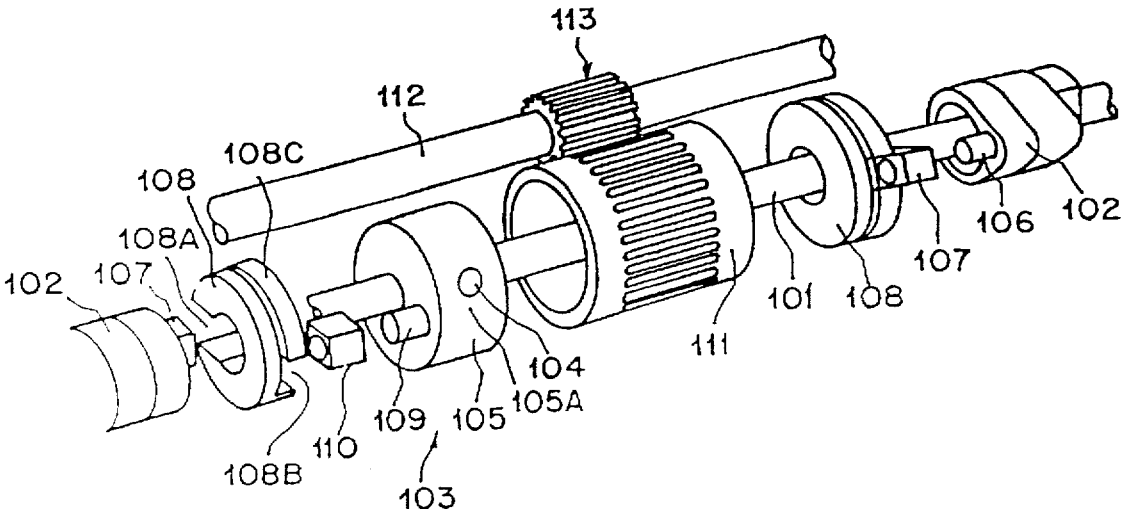
FIG. 16 PRIOR ART
FIG. 16 is a perspective view showing a variable valve timing camshaft mechanism (the first conventional art) as a conventional variable valve driving mechanism.
Figure 17:
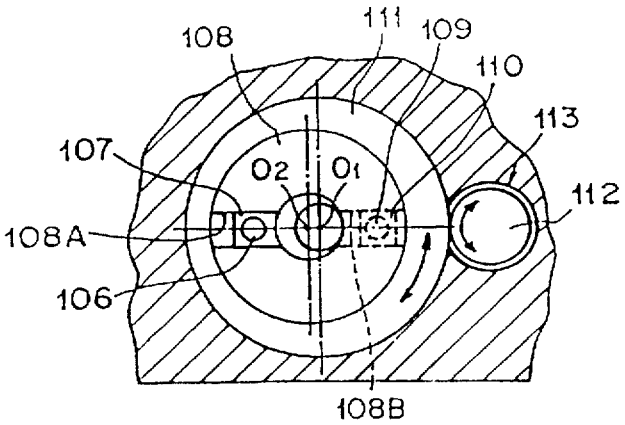
FIG. 17 PRIOR ART
FIG. 17 is a cross-sectional view showing the first conventional art.
Figure 18:
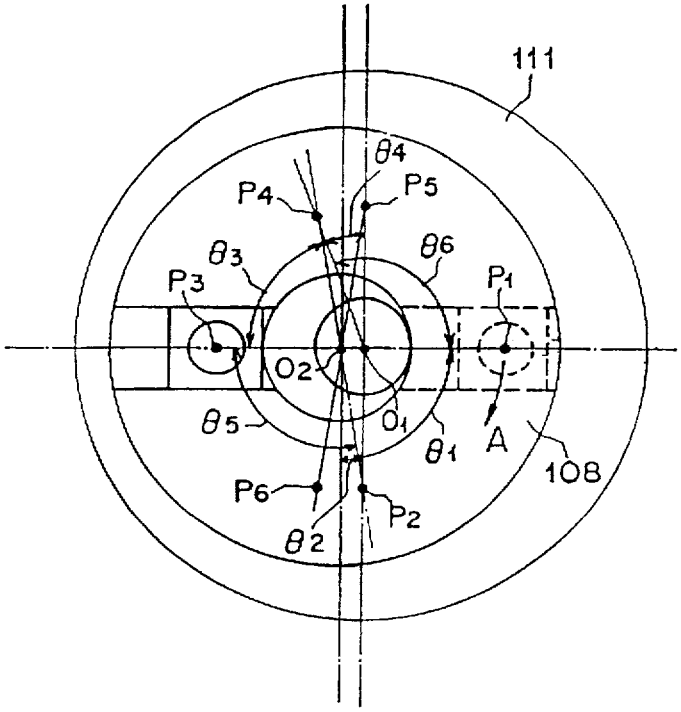
FIG. 18 PRIOR ART
FIG. 18 is a diagram describing an operation principle of a nonuniform speed coupling in the first conventional art.
Figure 19:
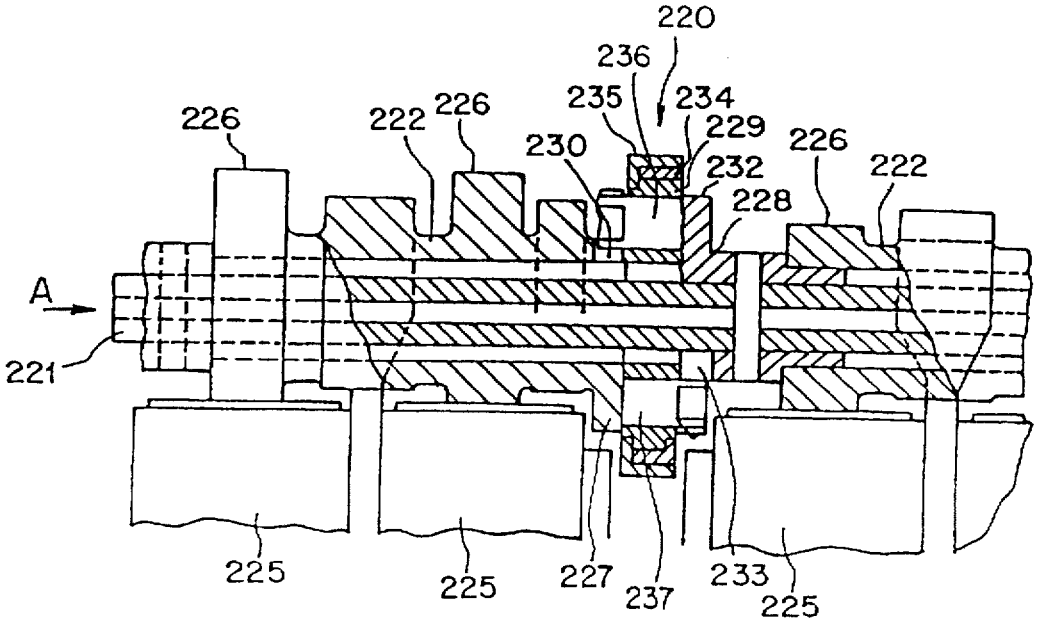
FIG. 19 PRIOR ART
FIG. 19 is a fragmentary vertical cross-sectional view illustrating, as a conventional variable valve driving mechanism, an intake valve drive control mechanism (the third conventional art) for an internal combustion engine.
Figure 20:
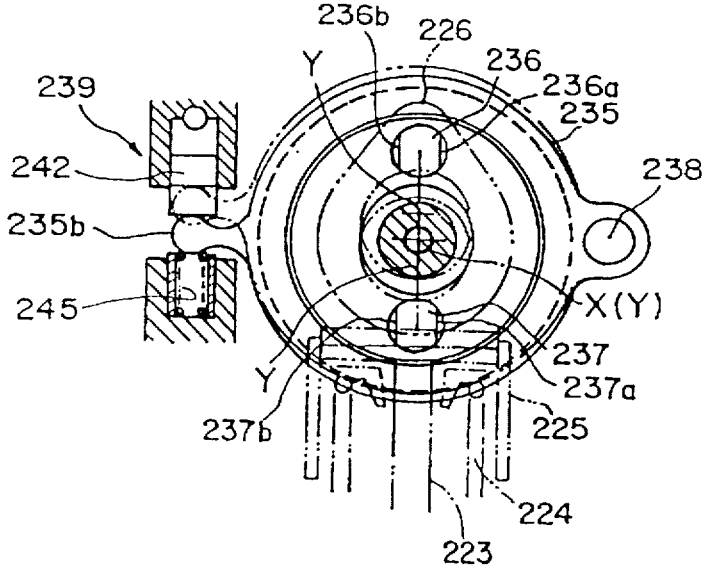
FIG. 20 PRIOR ART
FIG. 20 is a fragmentary transverse cross-sectional view showing the third conventional art.

Namely, as is illustrated in FIG. 15, the first slider groove (first groove portion) 19A is formed in the drive arm 19 and the second slider groove (second groove portion) 20A is formed in the arm portion 20 on the side of the cam lobe 12, and the first slider member 17 and the second slider member 18 are maintained in sliding engagement with the first slider groove 19A and the second slider grove 20A, respectively.

In this comparative example, the slider members 17,18 are also formed integrally with the pin members 23,24 and are constructed as the first pin member and second pin member, respectively.

Namely, as is depicted in FIG. 15, cam driving torque (see an arrow in FIG. 15) is transmitted from the drive arm 19 via the first slider groove (first groove portion) 19A and the slider member 17. On the other hand, valve spring force and inertia force (see arrows in FIG. 15) which act as reaction force to the cam driving torque are transmitted from the cam lobe 12 via the second slider groove (first groove portion) 29A and slider member 18.

Figure 13:
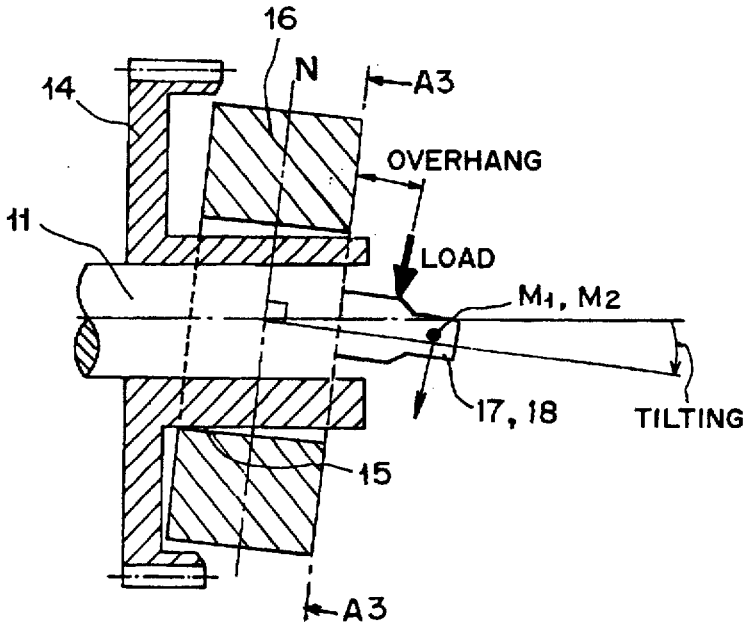
FIG. 13 is a reference view for describing the prevention of tilting of the nonuniform speed coupling in the first and second embodiments, and is a schematic fragmentary vertical cross-sectional view of the comparative example of the first and second embodiments.

However, different from the first embodiment, the loading points $M_1$,$M_2$ of the slider member 17,18 and pin members 23,24 are not located inside the engaging disk 16. Specifically, as is illustrated in FIG. 13, the loading points $M_1$,$M_2$ are offset relative to a center line N extending in the direction of the thickness of the engaging disk 16 so that they are overhung substantially.

Figure 14:
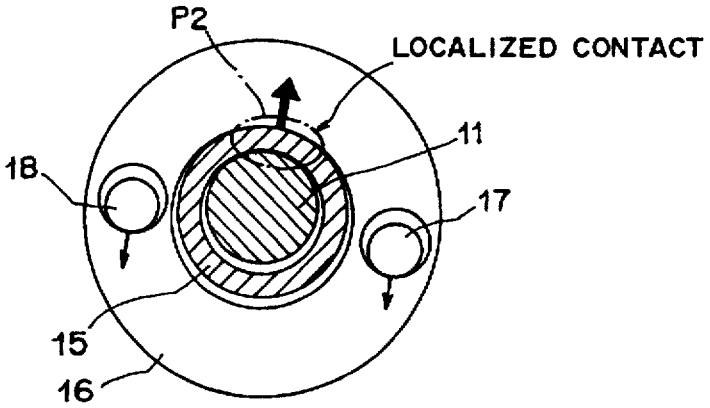
FIG. 14 is a reference view for describing the prevention of tilting of the nonuniform speed coupling in the first and second embodiments, and is a cross-sectional view taken in the direction of arrows A3—A3 of FIG. 13.

As a consequence, upon transmission of rotation from the camshaft 11 to the cam lobe 12 via the engaging disk 16, loads are applied from the pin members 23,24 in directions indicated by arrows in FIG. 14. As such loads act in perpendicular directions against the inner wall portions of the slider grooves 16A,16B from $M_1$,$M_2$ of the first and second pin members (the pin members 23,24 and the slider members 17,18), the thusloaded engaging disk 16 undergoes inclination (tilting) in the direction of an axis variation of the engaging disk 16 as shown in FIG. 13. In this case, a localized contact takes place at such a position as indicated by P2 in FIG. 14 so that friction at a sliding part or the like between the engaging disk 16 and the eccentric portion 15 increases. This makes it impossible to smoothly perform transmission of rotating force via the engaging disk 16 or a phase adjustment of the engaging disk 16, leading to a deterioration in the start-up performance of the engine.

In the variable valve driving mechanism according to the first embodiment, however, the loading points $M_1$,$M_2$ of the first and second pin members (the pin members 23,24 and the slider members 17,18) are located inside the engaging disk 16 as shown in FIG. 1. Namely, the loading points $M_1$,$M_2$ are not substantially offset relative to the central lien N extending in.the direction of the thickness of the engaging disk 16. Accordingly, tilting of the engaging disk 16 is prevented so that the engaging disk 16 can smoothly operate to assure operation of the above-described driving mechanism. The start-up performance of the engine is also improved. Incidentally, it would be more preferred to position the loading points $M_1$,$M_2$ on the central line N extending in the direction of the thickness of the engaging disk 16 if this would be feasible.

In the above variable valve driving mechanism, the member for adjusting the state of eccentricity at the nonuniform speed coupling 13, namely, the eccentric portion 15 is arranged inside the nonuniform speed coupling 13. This makes it possible to reduce the outer diameter of the whole nonuniform speed coupling, thereby bringing about the advantage that the whole system can be reduced in size.

Described specifically, there is a limitation imposed on an attempt to arrange torque transmitting members in the nonuniform speed coupling 13, namely, the drive pins 23,24 as close as possible to the center of rotation. Arrangement of an eccentricity-adjusting member (eccentric portion) outside the nonuniform speed coupling however leads to an unavoidable increase as much as the size of the member in the outer diameter of the nonuniform speed coupling. In the above-described driving mechanism, however, the eccentric portion 15 is arranged on a side inner than the drive pins 23,24. The outer diameter of the whole nonuniform speed coupling can therefore be reduced, thereby making it possible to reduce the overall size of the system.

Further, the above-described driving mechanism is of the construction that the cam lobe 12 is provided with the arm portion 20 which extends in the direction of the axis of the camshaft 11 and that the drive arm 19 is arranged in the space other than the arm portion 20 between the cam lobe 12 and the control disk 14 and extends toward the engaging disk 16 in the same direction as the pin members 23,24. This has brought about the advantage that the overall size of the system can be reduced.

The above-described driving mechanism has a double-shape structure that the cam lobe 12 is arranged outside the camshaft 11. Although it is of the construction that this camshaft 11 and this cam lobe 12 are maintained in sliding contact over an axially-long and wide area, the relative rotation between the camshaft 11 and the cam lobe 12 is as small as a phase change of the cam lobe 12 relative to the camshaft 11 as depicted in FIG. 6 and is thus extremely small compared with the speeds of rotation of the camshaft 11 and cam lobe 12.

Accordingly, wearing at the sliding part between this camshaft 11 and this cam lobe 12 is limited to an extremely small extent.

An adjustment of the eccentric position of the eccentric portion 15 is transmitted from the electric motor 33 via the motor-side gear 33A, the third gear 32C, the gear shaft 32A and the second gear 32B and then from the first gear 31 to the eccentric portion 15 of the control disk 14. As there is a relatively high tolerance in setting the distance between the third gear 32C and the second gear 32B, the rigidity of the gear shaft 32A and the like, it is easy to avoid effects such as twisting of the shafts upon adjustment of the eccentric position so that the driving of the valve can be performed at suitable timings.

According to this variable valve driving mechanism, each cylinder can be provided with its own nonuniform speed coupling 13. The driving mechanism can therefore be applied to all types of engines led by various types of in-series multicylinder engines such as 4-cylinder engines.

Referring next to FIG. 9 through FIG. 11, a description will be made about the second embodiment. The variable valve driving mechanism according to this embodiment is different from the first embodiment in the construction of some parts of the nonuniform speed coupling 13, namely, in the construction of the arm portion 20 formed as the mounting portion on the cam lobe 12, the construction of the sliding part between the eccentric portion 15 and the engaging disk 16 as the intermediate rotating member, etc. as shown in FIG. 9 through FIG. 11. The remaining construction is substantially the same as that of the first embodiment, so that a description will be made centering around the differences from the first embodiment.

Namely, as is depicted in FIG. 9, one side wall 16C of the engaging disk (intermediate rotating member) 16 faces the arm portion (mounting portion) 20 of the cam lobe 12. Specifically, the end face (flange portion) 20A of the arm portion 20 of the cam lobe 12 is in contact with the one side wall of the engaging disk (intermediate rotating member) 16. In the driving mechanism of this embodiment, the end face 20A of the arm portion 20 is arranged extending to an area of a phase difference of approximately 90° or greater relative to the slider groove (second groove portion) 16B formed in the arm portion 20. In particular, this extended portion is arranged as outside as possible from the central axis. It is designed that one side wall of the engaging disk 16 also contacts the thus-extended end face (flange portion) 20A of the arm portion.

Owing to this construction, the engaging disk 16 is brought into contact with the side of the cam lobe 12 at portions of end face 20A of the arm portion, said parts corresponding to areas indicated by mesh patterning in FIG. 10, namely, at contact portions (end faces of the arm portion) 20A arranged at locations $P_1$ on opposite sides of a central axis of the engaging disk 16 such as that extending substantially at a right angle with respect to a line connecting together the two slider grooves (the first and second groove portions) 16A,16B located to flank the central axis of the engaging disk 16 therebetween. The engaging disk 16 is therefore prevented from inclining (tilting) in the direction of its axis deviation.

In this embodiment, the slider members 17,18 are formed integrally with the pin members 23,24 as the first pin member and second pin member, respectively.

In the above-described driving mechanism, the one side wall of the engaging disk 16 is maintained in contact with the end face of the arm portion flange portion) 20A, especially in contact with the extended portions (see the portions indicated by mesh patterning in FIG. 10) of the end fact 20A of the arm portion, said extended portions being located on a line extending substantially at a right angle with respect to a line connecting together the pin members 23 and 24 and as outside as possible from the central axis, so that inclination (tilting) of the engaging disk 1.6 such as that mentioned above (see FIG. 13) can be prevented.

Further, the cam lobe 12 is provided at a rear end thereof with a waved washer 36 to increase contacting force of the end face 20A of the arm portion to the one side wall of the engaging disk 16, so that a sufficient tilting preventing load can be assured for the engaging disk 16.

Because the essential portions of the end face 20A of the arm portion (see mesh-patterned areas $P_1$ in FIG. 10), said essential portions being capable of working particularly effectively for the prevention of tilting of the engaging disk 16, are arranged as outside as possible from the central axis, the tilting preventing load of the waved washer 36 is exhibited extremely effectively. As the waved washer 36, it is therefore possible to one having relatively low resiliency, that is, a small one.

The engaging disk 16 and the cam lobe 12 rotate while producing a small phase deviation therebetween in accordance with its eccentricity as mentioned above, so that the contacting portions of the engaging disk 16 and the end face 20A of the arm portion slightly slide against each other. As a lubricating oil (engine oil) is supplied to these portions, smooth sliding is assured.

In this embodiment, the loading points $M_1$,$M_2$ are located inside the engaging disk 16 as in the first embodiment so that like the first embodiment, tilting of the engaging disk 16 is prevented. Further tilting preventing effects or the engaging disk 16 are also added owing to the contact of the end face 20A of the arm portion with the one side wall of the engaging disk 16, whereby still greater effects have been brought about for the prevention of tilting of the engaging disk 16. However, tilting of the engaging disk 16 can also be prevented only by a construction such that the end face 20A of the arm portion is supportingly maintained in contact with the one side wall of the engaging disk 16.

In this embodiment, a bearing 37 is additionally interposed at a sliding part between the engaging disk 16 and the eccentric portion 15, namely, between the outer periphery of the eccentric portion 15 and the inner periphery of the engaging disk 16. Employed here is a needle bearing which can be interposed with a smaller dimensional increase. However, the bearing 37 is not limited to such a needle bearing, and various bearings can be used.

When such a sliding part between the engaging disk 16 and the eccentric portion 15 is formed as a "mere slide bearing", large friction is developed between the engaging disk 16 and the eccentric portion 15 especially due to the viscosity of the lubricating oil at the time of a start-up of the engine. Owing to the provision of this bearing 37, the friction between the engaging disk 16 and the eccentric portion 15 is substantially reduced, so that transmission of rotating force through the engaging disk 16 and a phase adjustment can be smoothly performed and the start-up performance of the engine can also be improved. Conversely speaking, a load applied on a starter or an actuator upon start-up or adjustment of an eccentric position can be significantly reduced so that as such a starter or actuator, one having low capacity and a small size can be adopted.

It is also possible to arrange a bearing such as a needle bearing at the sliding part between the eccentric portion 15 and the camshaft 11 or to arrange such a bearing not only at the sliding part between the engaging disk 16 and the eccentric portion 15 but also at the sliding part between the eccentric portion 15 and the camshaft 11. However, the interposition of the bearings at both the sliding parts leads to an enlargement in the external shape at the sliding parts and hence to an increase in the size of the system and a reduction in the mountability of the system. If this matter causes a problem, it is desired to interpose a bearing at only one of the sliding parts.

When such a bearing is interposed at only one of the sliding parts as described above, it is preferred to arrange it at the sliding part between the engaging disk 16 and the eccentric portion 15, said sliding part having a greater diameter than, that between the camshaft 11 and the eccentric portion 15, because bearing effects can be exhibited more efficiently.

Incidentally, signs 7A,11A,11B in FIG.9 through FIG. 11 indicate oilways for feeding lubricating oil (engine oil) to the corresponding sliding parts.

Since this embodiment is constructed as described above, its nonuniform speed coupling acts in substantially the same manner as in the first and second embodiments so that the opening and closing timings, open period and the like of the valve can be adjusted in accordance with the state of operation of the engine. In addition, there are other specific actions, effects and advantages as will be described below.

Because the one side wall of the engaging disk 16 is maintained in contact with the end face 20A of the arm portion, inclination (tilting) of the engaging disk 16 in the direction of its axis deviation such as that illustrated in FIG. 13 can be prevented. The engaging disk 16 can therefore smoothly operate, thereby effectively assuring the operation of the above-described driving mechanism.

In particular, the essential portions (see the mesh-patterned areas P1 in FIG. 10) of the end face 20A of the arm portion, said essential portions being particularly effective for the prevention of tilting of the engaging disk 16, are arranged as outside as possible from the central axis. The prevention of tiling of the engaging disk 16 is therefore achieved extremely effectively. Further, owing to the tilting-preventing load applied by the waved washer 36, the end face 20A of the arm portion surely exhibits its effects for the prevention of tilting of the engaging disk 16. Especially, the essential portions of the end face 20A of the arm portion are arranged as outside as possible from the central axis, so that the tilting-preventing load by the waved washer 36 is exhibited extremely effectively. As the waved washer 36, the above-described driving mechanism therefore permits use of one having lower resiliency, namely, a smaller size.

When the engaging disk 16 is prevented from tilting as described above, a still further effect can be brought about that, even when a needle bearing is adopted, an inconvenience such as skew does not take place.

As in the first embodiment, the loading points $M_1$,$M_2$ are located inside the engaging disk 16 so that this feature is combined with the feature specific to this embodiment that the end face 20A of the arm portion is supportingly maintained in contact with the one side wall of the engaging disk 16, the tiltingpreventing effects for the engaging disk 16 are assured further.

Further, the bearing 37 is interposed at the sliding part between the engaging disk 16 and the eccentric portion 15 so that the friction between the engaging disk 16 and the eccentric portion 15 is reduced considerably. Transmission of rotating force through the engaging disk 16 and a phase adjustment can therefore be more smoothly performed. Especially at the time of a start-up, large friction tends to occur between the engaging disk 16 and the eccentric portion 15 especially due to the viscosity of the lubricating oil at the time of a start-up of the engine. As such friction is substantially reduced even in such a case, and the start-up performance of the engine can also be improved.

Conversely speaking, a load applied on a starter or an actuator upon start-up or adjustment of an eccentric position can be significantly reduced so that as such a starter or actuator, one having low capacity and a small size can be advantageously adopted.

Further, a bearing such as a needle bearing is arranged at the sliding part between the engaging disk 16 and the eccentric portion 16, said sliding part having a greater diameter than the sliding part between the camshaft 11 and the eccentric portion 15. Bearing effects can therefore be exhibited more efficiently, and the above-mentioned reduction of friction can be achieved more effectively.

Since the bearing such as a needle bearing is arranged only between the engaging disk 16 and the eccentric portion 15, there is a still further advantage of reduced possibility that the outer shape would be enlarged there, leading to enlargement and reduced mountability of the system, an increased number of parts, components and the like, increased cost and the like.

Needless to say, it is possible to construct a variable valve driving mechanism by singly using the essential features in the above-described respective embodiments, especially the setting of the positions of the loading points $M_1$,$M_2$, the formation of the end portion 20A of the arm portion, the interposition of the bearing 37 and the like or by combining them as needed.

In particular, inclusion of all the above features is most effective from the viewpoint of improving start-up performance of an engine.

In the individual embodiments, the valve driving between the valve stem and the cam is performed in different ways. The present variable valve driving mechanism should not limit anything or should not be limited in any way with respect to the manner of such valve driving, and is applicable to various valvedriving manners.

Capability of Exploitation in Industry

Use of the present application in an internal combustion engine can make appropriate the timings of opening and closing of a valve and its open period in accordance with a state of operation of the engine, thereby making it possible to simultaneously meeting mutually contradictory demands such as an increase in the power output of the engine and an improvement in the gas mileage of the engine. Adoption of this invention in an engine for an automotive vehicle can significantly improve the performance of the automotive vehicle, namely, both its power output performance and its economical performance. Obviously, the present invention can also be adopted in fields other than automotive vehicles, and can likewise bring about the advantage that it can achieve both an improvement in power output performance and an improvement in economical performance. The present invention is therefore considered to have extremely high utility.

We claim:

1. A variable valve driving mechanism comprising:

a camshaft rotationally driven by a crankshaft of an internal combustion engine;

an eccentric member having an annular eccentric portion, which is eccentric relative to said camshaft, and rotatably arranged on an outer periphery of said camshaft;

an intermediate rotating member defining therein a first groove portion and a second groove portion, which extend in radial directions, and rotatably supported on said eccentric portion;

a cam lobe having a cam portion for opening and closing a valve member, which regulates an inducted-air-charging period or an exhaust-gas-discharging period of a combustion chamber of said internal combustion engine, said cam lobe being arranged concentrically with said camshaft and rotatable relative to said camshaft;

a first pin member slidably fitted at one end thereof in said first groove portion and connected at an opposite end thereof to said camshaft so that rotation of said camshaft is transmitted to said intermediate rotating member;

a second pin member slidably fitted at one end thereof in said second groove portion and connected at an opposite end thereof to said cam lobe so that rotation of said intermediate rotating member is transmitted to said cam lobe; and eccentric position adjusting means for rotating said eccentric member in accordance with a state of operation of said internal combustion engine so that an eccentric position of said eccentric portion is adjusted.

2. The variable valve driving mechanism of claim 1, further comprising:

a mounting portion formed at an end portion of said cam lobe so that said mounting portion extends toward said eccentric member along a rotary axis of said camshaft; and an arm member disposed within a space other than said mounting portion between said cam lobe 112)-and said eccentric member, said arm member being integral with said camshaft and extending in a radial direction of said camshaft; wherein said opposite end of said first pin member is rotatably connected to said arm member, and said opposite end of said second pin member is rotatably connected to said mounting portion; and axes of said first and second pin members are set in parallel with said rotary axis.

3. The variable valve driving mechanism of claim 2, wherein said intermediate rotating member faces said end portion of said cam lobe, and said cam lobe is provided with a contact portion which is maintained in contact with one side wall of said intermediate rotating member to limit tilting of said intermediate rotating member in the direction of an axis deviation.

4. The variable valve driving mechanism of claim 3, wherein a bearing is interposed at least between said eccentric member and said intermediate rotating member.

5. A variable valve driving mechanism comprising:

a camshaft rotationally driven by a crankshaft of an internal combustion engine;

an eccentric member having an annular eccentric portion, which is eccentric relative to said camshaft, and rotatably arranged on an outer periphery of said camshaft; g1 an intermediate rotating member defining therein a first groove portion and a second groove portion which extend in radial directions, and rotatably supported on said eccentric portion;

a cam lobe having a cam portion for opening and closing a valve member, which regulates an inducted-air-charging period or an exhaust-gas-discharging period of a combustion chamber of said internal combustion engine, said cam lobe being arranged concentrically with said camshaft and rotatable relative to said camshaft;

a contact portion formed on one of said camshaft and said cam lobe so that said contact portion is maintained in contact with one side wall of said intermediate rotating member to limit tilting of said intermediate rotating member in the direction of an axis deviation;

a first pin member connected slidably in a radial direction at one end thereof to one of said camshaft and said intermediate rotating member and connected at an opposite end thereof to the other one of said camshaft and said intermediate rotating member so that rotation of said camshaft is transmitted to said intermediate rotating member;

a second pin member connected slidably in a radial direction at one thereof to one of said intermediate rotating member and said cam lobe and connected at an opposite end thereof to the other one of said camshaft and said intermediate rotating member so that the rotation of said intermediate rotating member is transmitted to said cam lobe; and eccentric position adjusting means for rotating said eccentric member in accordance with a state of operation of said internal combustion engine so that an eccentric position of said eccentric portion is adjusted.

6. A variable valve driving mechanism comprising:

a camshaft rotationally driven by a crankshaft of an internal combustion engine;

an eccentric member having an annular eccentric portion, which is eccentric relative to said camshaft, and rotatably arranged on an outer periphery of said camshaft;

an intermediate rotating member defining therein a first groove portion and a second groove portions which extend in radial directions, and rotatably supported on said eccentric portion;

a cam lobe having a cam portion for opening and closing a valve member, which regulates an inducted-air-charging period or an exhaust-gas-discharging period of a combustion chamber of said internal combustion engine, said cam lobe being arranged concentrically with said camshaft and rotatable relative to said camshaft;

a first pin member connected slidably in a radial direction at one end thereof to one of said camshaft and said intermediate rotating member and connected at an opposite end thereof to the other one of said camshaft and said intermediate rotating member so that rotation of said camshaft is transmitted to said intermediate rotating member;

a second pin member connected slidably in a radial direction at one end thereof to one of said intermediate rotating member and said cam lobe and connected at an opposite end thereof to the other one of said camshaft and said intermediate rotating member so that rotation of said intermediate rotating member is transmitted to said cam lobe;

eccentric position adjusting means for rotating said eccentric member in accordance with a state of operation of said internal combustion engine so that an eccentric position of said eccentric portion is adjusted; and a bearing interposed at least one of between said eccentric member and said intermediate rotating member and between said camshaft and said eccentric member.

* * * * *